US007054579B2

(12) United States Patent
Taniguchi et al.

(10) Patent No.: US 7,054,579 B2
(45) Date of Patent: May 30, 2006

(54) CHARGING MEMBER, PROCESS CARTRIDGE, AND ELECTROPHOTOGRAPHIC APPARATUS

(75) Inventors: Tomohito Taniguchi, Shizuoka (JP); Seiji Tsuru, Shizuoka (JP); Noriaki Kuroda, Shizuoka (JP); Hiroshi Inoue, Kanagawa (JP); Toshihiro Otaka, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 26 days.

(21) Appl. No.: 10/871,015

(22) Filed: Jun. 21, 2004

(65) Prior Publication Data

US 2004/0265006 A1 Dec. 30, 2004

(30) Foreign Application Priority Data

Jun. 30, 2003 (JP) ..... 2003-187462

(51) Int. Cl.
*G03G 21/00* (2006.01)

(52) U.S. Cl. ..... 399/174; 399/176

(58) Field of Classification Search ..... 399/148, 399/168, 175, 176, 174
See application file for complete search history.

(56) References Cited

U.S. PATENT DOCUMENTS

| | | | | |
|---|---|---|---|---|
| 5,548,380 | A | 8/1996 | Naka et al. | 355/219 |
| 5,776,544 | A | 7/1998 | Naka et al. | 427/307 |
| 6,272,301 | B1 * | 8/2001 | Kawada et al. | 399/148 |
| 6,337,962 | B1 | 1/2002 | Inoue et al. | 399/111 |
| 6,400,919 | B1 | 6/2002 | Inoue et al. | 399/176 |
| 6,558,781 | B1 | 5/2003 | Fuei et al. | 428/212 |
| 2003/0219589 | A1 | 11/2003 | Taniguchi et al. | 428/323 |

FOREIGN PATENT DOCUMENTS

| | | |
|---|---|---|
| JP | 07-199593 | 8/1995 |
| JP | 2000-214657 | 8/2000 |

* cited by examiner

*Primary Examiner*—Hoang Ngo
(74) *Attorney, Agent, or Firm*—Fitzpatrick, Cella, Harper & Scinto

(57) ABSTRACT

In a charging member having a support and one or more cover layer(s), the ten-point average surface roughness of the surface of the charging member, the height of a hill of the surface of the charging member, the area at the part of the hill, and the area of a region surrounded by hills each having the height H (μm) and other hills each having a height of not less than the height H (μm), and not including any hills having a height of more than 0.5H (μm) satisfy a specific relationship. Also, a surface layer of the charging member contains high-molecular compound particles whose average particle diameter is between 2 and 50 μm and whose range of particle size distribution of average particle diameter is above 0μm and not greater than 7 μm.

27 Claims, 5 Drawing Sheets

CHARGING MEMBER, PROCESS CARTRIDGE, AND ELECTROPHOTOGRAPHIC APPARATUS

BACKGROUND OF THE INVENTION

1. Field of the Invention

This invention relates to a charging member, and a process cartridge and an electrophotographic apparatus which have the charging member.

2. Related Background Art

Image forming apparatus that employ electrophotography, what is called electrophotographic apparatus, are commonly those having an electrophotographic photosensitive member, a charging means, an exposure means, a developing means and a transfer means.

As this charging means, mainly employed is one having a system in which a voltage (a DC voltage only or a voltage formed by superimposing an AC voltage on a DC voltage) is applied to a charging member disposed in contact with, or in proximity to, the surface of an electrophotographic photosensitive member, to charge the surface of the electrophotographic photosensitive member electrostatically.

In the case when the voltage formed by superimposing an AC voltage on a DC voltage is employed as the voltage to be applied to the charging member, an AC power source is necessary which makes the electrophotographic apparatus large or brings about a rise in cost, which may result in a larger power consumption, and which may produce ozone at a high level because of the use of an alternating current that causes a lowering of durability (running performance) of the charging member or the electrophotographic photosensitive member. Accordingly, from this viewpoint, it is preferable that the voltage to be applied to the charging member is only a DC voltage.

In recent years, there has been demand for an electrophotographic apparatus that achieves much higher image quality. Where any conventional charging members are used, however, white or black lines or dots may occur, density non-uniformity due to adhesion of foreign matter or adhesion non-uniformity of foreign matter to the surface of the charging member may occur, or lines or dots due to the profile of the surface of the charging member may occur, depending on certain specific conditions (such as the applied voltage, the environment of image reproduction, and patterns of reproduced images). Such problems have tended to come about especially when the voltage applied to the charging member only a voltage DC voltage.

In addition, in recent years, there has been a demand for an electrophotographic apparatus to achieve much higher running performance, and, as a matter of course, for the charging member to be set therein as well, there has been a demand to achieve much higher running performance.

For example, Japanese Patent Applications Laid-open No. H07-199593 and No. 2000-214657 disclose a technique in which the profile of the surface of the charging member is controlled to improve charging uniformity and running performance or to achieve a reduction in image defects.

At present, there is a demand for an electrophotographic apparatus of much higher added value on the condition that high image quality and high running performance are achieved. An example of such added value may include an apparatus to form good images on transfer materials of various types.

For example, where, e.g., presentation is performed, an overhead projection transparent PET film (hereinafter "OHT") is used and images are formed thereon in many cases. Also, opportunities are increasing in which electronic image data obtained by photographing with digital cameras or the like are outputted using a printer or photographs are copied using a copying machine. When photographic images are reproduced, specialty paper such as surface-treated paper and high-gloss paper are often used as transfer materials.

Thick and small specialty media such as postcards are also highly frequently used.

The OHT and specialty media often differ in thickness, size, and material compared with plain paper. In order to form good images on these media, the process speed (PS) is often made lower than the case when the plain paper is used as a transfer material, to adapt to such differences.

In order to adapt to transfer materials of various types, which differ in thickness or size and also in material, it is preferable that one electrophotographic apparatus can be set to a plurality of different process speeds. Stated specifically, it means that process speeds can be set to, e.g., ½ speed, ⅓ speed and ¼ speed on the basis of standard speed. Stated more specifically, it means that the apparatus is used at a process speed of 94 mm/second (standard speed) when the plain paper is used as the transfer material, and is used at a process speed switched to 31 mm/second (⅓ speed) when the OHT is used as the transfer material.

However, studies made by the present inventors have revealed that such differences in process speed have a great influence on charging uniformity, and furthermore on the uniformity of reproduced images (image uniformity).

In order to achieve a uniform state in the charging of the electrophotographic photosensitive member, the quantity of electric charges per unit area on the surface of the electrophotographic photosensitive member must be constant. Here, a large quantity of electric charges must be fed to the surface of the electrophotographic photosensitive member per unit time when the process speed is high, and a small quantity of electric charges may be fed when the process speed is low. That is, if the process speed of an electrophotographic apparatus to be used is determined, the charging member may be contrived in conformity therewith.

However, where the electrophotographic apparatus to be used is the electrophotographic apparatus which can be set to a plurality of different process speeds, even if high charging uniformity and furthermore high image uniformity can be achieved at a certain process speed, the charging member becomes over-discharged when the process speed is switched to a speed lower than that, so that a locally over-charged condition may be produced on the surface of the electrophotographic photosensitive member to cause white horizontal lines on reproduced images. Also, when the process speed is switched to a speed higher than that, the charging member becomes under-discharged, so that a locally under-charged condition may be produced on the surface of the electrophotographic photosensitive member to cause black horizontal lines on reproduced images.

This problem tends to occur especially when images are reproduced in a low-humidity environment. This problem also tends to occur especially when the voltage applied to the charging member is only a voltage (i.e., when the AC voltage, having a leveling effect, is not used as the voltage applied to the charging member).

In addition, in the case of the electrophotographic apparatus which can be set to a plurality of different process speeds, the state of static/dynamic contact between the electrophotographic photosensitive member and the charging member, the torque, the state of rubbing, the state of application of voltage to the charging member, and so forth come to change, and hence various stresses tend to be applied to the charging member, compared with an electrophotographic apparatus whose process speed is set to a single value. Hence, the surface of the charging member tends to suffer increased wear, so that the deterioration of the charging member may to make it difficult to maintain high image quality.

This problem also tends to occur especially when images are reproduced in a low-humidity environment or when the voltage applied to the charging member is only a DC voltage.

It has also been found that these problems occur also on the charging member disclosed in Japanese Patent Applications Laid-open No. H07-199593 and No. 2000-214657.

Now, making image quality higher can be achieved to a certain extent by improving charging uniformity. However, as disclosed in Japanese Patent Application Laid-open No. 2000-214657, it has come to light that some image defects, such as black dots, or white dots occurring on reproduced images are caused by the charging member. Such image defects are caused by hills or valleys of the surface of the charging member.

Japanese Patent Application Laid-open No. 2000-214657 discloses a charging member characterized by having no protuberances of 5 μm in height at the surface of the charging member. This charging member enables prevention of the black dots or white dots on reproduced images, but is unable to achieve the charging uniformity adapted to a plurality of different process speeds.

It has also come to light that, in the case when the voltage applied to the charging member is only a DC voltage, the charging uniformity may well come into question, but image defects caused by any defects of the surface of the charging member may become very conspicuous.

SUMMARY OF THE INVENTION

An object of the present invention is to provide a charging member that enables reproduction of good images free of any image defects (in particular, with the prevention of the occurrence of horizontal lines), even when the electrophotographic apparatus to be used is the electrophotographic apparatus which can be set to a plurality of different process speeds, and to provide a process cartridge and an electrophotographic apparatus which have such a charging member.

The present invention is a charging member comprising a support and one or more cover layer(s) provided thereon, wherein:

where the ten-point average surface roughness of the surface of the charging member is represented by Rz (μm), the Rz satisfies the expression (1):

$$2 \leqq Rz \leqq 50 \quad (1);$$

an area Sa ($\mu m^2$) at the part of a hill of the surface of the charging member, having a height H (μm) satisfies the expressions (2) and (3) in relation to the Rz:

$$H \leqq 14 \times \log_e Rz \quad (2); \text{ and}$$

$$\log_e H \geqq 0.03 \times Rz + \log_e 7 \quad (3);$$

and satisfies the expression (4):

$$0 < Sa \leqq 2{,}500 \times \log_e Rz + 5{,}500 \quad (4); \text{ and}$$

an area Sb ($\mu m^2$) of a region of the surface of the charging member, surrounded by hills each having the height H (μm) that satisfies the expressions (2) and (3) in relation to the Rz and other hills each having a height of not less than the height of the former hills, and not including on the inside thereof any hills having a height of more than 0.5 time the height of the former hills, satisfies the expression (5):

$$\log_e Sb \leqq -0.04 \times H + \log_e 35{,}000 \quad (5).$$

The present invention is also a charging member comprising a support and one or more cover layer(s) provided thereon, wherein;

of the cover layer(s), a cover layer serving as a surface layer of the charging member contains high-molecular compound particles and, where the average particle diameter of the high-molecular compound particles is represented by A (μm), $2 \leqq A \leqq 50$, and the range of particle size distribution of the high-molecular compound particles is more than 0 (μm) to 7 A (μm) or less.

The present invention is still also a process cartridge and an electrophotographic apparatus which have the above charging member.

DESCRIPTION OF THE PREFERRED EMBODIMENTS

The fact that the charging member charges the surface of the electrophotographic photosensitive member means that an electrical discharge from the charging member to the surface of the electrophotographic photosensitive member takes place and electric charges move there. Where a certain point of the surface of the charging member is represented by X, and a point at which a line that passes the point X and is formed by extending the radius of the charging member intersects the surface of the electrophotographic photosensitive member is represented by Y, the discharge takes place when a potential difference Vxy between the point X and the point Y exceeds a Paschen's discharge limit voltage (discharge start voltage) Vpa, where electric charges ΔQ move to the surface of the electrophotographic photosensitive member, and reverse electric charges −ΔQ move to the surface of the charging member. The total sum of this ΔQ corresponds to the electric charges Q accumulated on the surface of the electrophotographic photosensitive member. A potential V of the surface of the electrophotographic photosensitive member may be calculated from the relationship of V=Q/C (C is the electrostatic capacitance of a layer formed on the support of the electrophotographic photosensitive member). Here, the electric charges (density of released electric charges) ΔQ may be calculated from the formula (6):

$$\Delta Q=((Vxy-Vpa)\times(D+G))/(D\times G) \tag{6}$$

Figure 1:
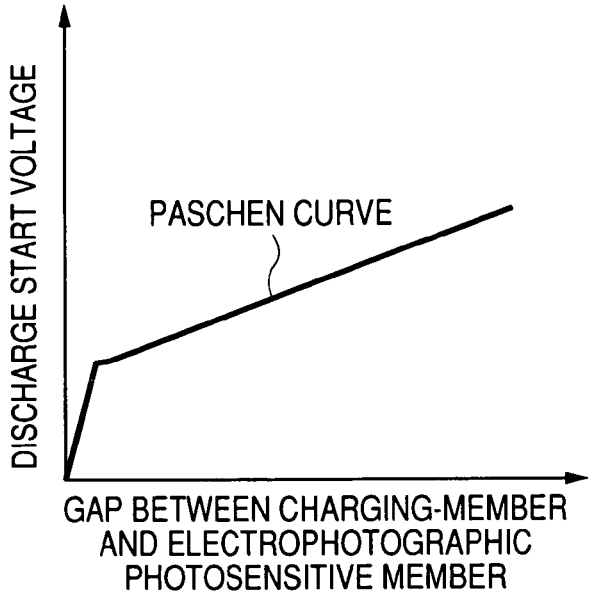
FIG. 1 is a graph which illustrates the Paschen law.

D in the formula (6) is $D=\Sigma di/\in i=dc/\in c+dp/\in p$, where dc is the total (total layer thickness) (m) of the thickness of the layer(s) (one layer or two or more layers) formed on the support of the charging member, dp is the total (total layer thickness) (m) of the thickness of the layer(s) (one layer or two or more layers) formed on the support of the electrophotographic photosensitive member, ∈c is the dielectric constant of the layer(s) formed on the support of the charging member, ∈p is the dielectric constant of the layer(s) formed on the support of the electrophotographic photosensitive member, G is the distance (gap) (m) between the point X and the point Y, Vxy is the potential difference (V) between the point X and the point Y, and Vpa is the discharge start voltage (V) derived from the formula (7) and the Paschen law shown in FIG. 1.

$$Vpa=\begin{cases}7.5\times G(0<G\leq 4.8\ (\mu m))\\ 360(4.8<G\leq 7.7\ (\mu m))\\ 312+6.2\times G(7.7<G\ (\mu m))\end{cases} \tag{7}$$

What the formula (6) shows is that the electric charges ΔQ that move as a result of discharge depends on G, i.e., the gap between the charging member and the electrophotographic photosensitive member. Where the surface of the charging member is smooth (i.e., where its distance to the surface of the electrophotographic photosensitive member is uniform), it follows that, in the directions crossing the direction of movement of the surface of the charging member at right angles (hereinafter simply also "crossed directions"), the ΔQ (and −ΔQ) move theoretically uniformly between the charging member and the electrophotographic photosensitive member as a result of discharge.

In practice, however, it is very difficult to make uniform the thickness of the cover layer(s) and the state of presence of various materials constituting the cover layer(s), and hence it is very difficult to make uniform the surface of the charging member. Thus, in practice, it is impossible to make the ΔQ (and −ΔQ) move perfectly uniformly as a result of discharge. That is, it follows that a portion or portions having the possibility of affecting the discharge are so present at the surface of the charging member that it or they may be said to be always present.

The fact that the charging uniformity depends on process speed namely means that the state of discharge caused by the charging member depends on the process speed. Therefore, what portion(s) among the portions having the possibility of affecting the discharge on the surface of the charging member may cause faulty charging (over-discharge or under-discharge) depends on the process speed of the electrophotographic apparatus in which that charging member is used.

In the case when the electrophotographic apparatus in which the charging member is to be used is an electrophotographic apparatus whose process speed is set to a single value, that charging member may be designed and optimized in conformity with that process speed, whereby the faulty discharge and/or the image defects to be caused by the faulty discharge can be prevented or reduced.

However, in the case when the electrophotographic apparatus in which the charging member is to be used is an electrophotographic apparatus which can be set to a plurality of different process speeds, even if the faulty discharge and/or the image defects to be caused by the faulty discharge in the case of image formation carried out at one process speed can be restrained by designing that charging member in conformity with that one process speed, it is difficult to prevent or reduce the faulty discharge and/or the image defects to be caused by the faulty discharge in the case of image formation carried out at process speed other than that one process speed. It is very difficult to do so especially when the plurality of different process speeds is more than a range of 10% (((high-speed PS—low-speed PS)/low-speed PS)×100).

Where a portion of the surface of the charging member is a portion that causes over-discharge (over-discharge portion), a phenomenon takes place in which electric charges flow out from that over-discharge portion to portions which adjoin that over-discharge portion in the crossed directions and where the over-discharge does not occur by nature. Hence, the over-discharge portion may inevitably be expanded in the crossed directions. On the other hand, where a portion of the surface of the charging member is a portion that causes under-discharge (under-discharge portion), a phenomenon takes place in which electric charges flow out to that under-discharge portion from portions which adjoin that under-discharge portion in the crossed directions and where the under-discharge does not occur by nature. Hence, the under-discharge portion may inevitably be expanded in the crossed directions. Also, the larger the range of the portions which adjoin the over-discharge portion or under-discharge portion and where the over-discharge or under-discharge does not occur by nature, and consequently the higher the smoothness of the surface of the charging member, the more the over-discharge portion or under-discharge portion become expanded. Then, once the over-discharge portion or under-discharge portion has come expanded, it may come about that white or black horizontal lines (lines in the crossed directions) appear conspicuously on reproduced images.

That is, the surface of the charging member may be made rough to a certain degree, whereby the over-discharge portion or under-discharge portion can be prevented at least to some degree from being expanded, and thereby the horizontal lines can be prevented at least to some degree from occurring on reproduced images (restrained enough for any horizontal lines not to be visually recognizable on reproduced images).

Meanwhile, it is not the case that it is better if the surface of the charging member is merely made more rough. This is for the following reasons: It follows that, making the surface of the charging member rough means that the electric charges ΔQ which move as a result of discharge differ depending on the places which causes the discharge, where, in order to achieve charging uniformity, the total sum of ΔQ, i.e., the electric charges Q accumulated on the surface of the electrophotographic photosensitive member must be made uniform (uniform enough for any image defects not to be visually·recognizable). For example, if the surface of the charging member has been made so rough that very large hills or valleys are present at the surface of the charging member, it may come about that white or black dots caused by those hills or valleys appear conspicuously on reproduced images.

The present inventors have made extensive studies. As the result, it has been found that the above problems can be solved by using as the charging member:

(I) a charging member comprising a support and one or more cover layer(s) thereon, wherein;

where the ten-point average surface roughness of the surface of the charging member is represented by Rz (μm), the Rz satisfies the expression (1):

$$2 \leqq Rz \leqq 50 \quad (1);$$

an area Sa ($\mu m^2$) at the part of a hill of the surface of the charging member, having a height H (μm) that satisfies the expressions (2) and (3) in relation to the Rz:

$$H \leqq 14 \times \log_e Rz \quad (2); \text{ and}$$

$$\log_e H \geqq 0.03 \times Rz + \log_e 7 \quad (3);$$

satisfies the expression (4):

$$0 < Sa \leqq 2{,}500 \times \log_e Rz + 5{,}500 \quad (4); \text{ and}$$

an area Sb ($\mu m^2$) of a region of the surface of the charging member, surrounded by hills each having the height H (μm) that satisfies the expressions (2) and (3) in relation to the Rz and other hills each having a height of not less than the height of the former hills, and not including on the inside thereof any hills having a height of more than 0.5 time the height of the former hills, satisfies the expression (5):

$$\log_e Sb \leqq -0.04 \times H + \log_e 35{,}000 \quad (5); \text{ or}$$

(II) a charging member comprising a support and one or more cover layer(s) thereon, wherein;

of the cover layer(s), a cover layer serving as a surface layer of the charging member contains high-molecular compound particles and, where the average particle diameter of the high-molecular compound particles is represented by A (μm), $2 \leqq A \leqq 50$, and the range of particle size distribution of the high-molecular compound particles is more than 0 (μm) to 7 A (μm) or less.

Figure 2:
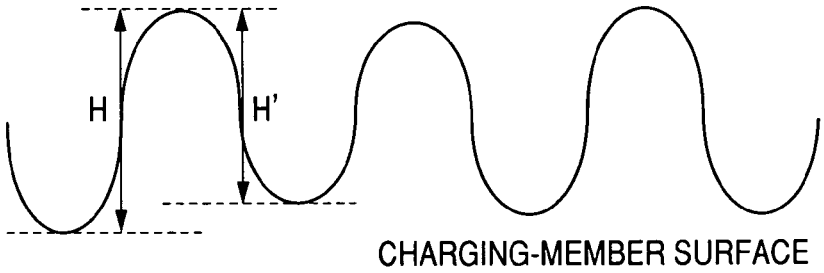
FIG. 2 is a schematic view which illustrates the height H of a hill.

The H in the formulas (2), (3) and (5) is, as shown in FIG. 2, the height H on the basis of the lowest point of the hill (that is, it is not H').

Figure 3:
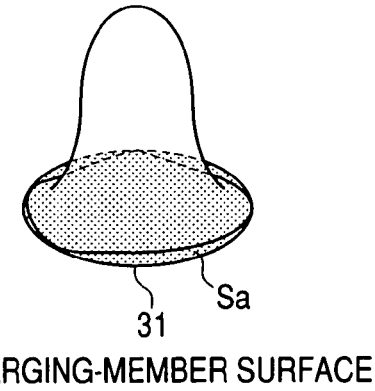
FIG. 3 is a schematic view which illustrates the area Sa at the part of a hill.

The Sa in the formula (4) is, as shown in FIG. 3, area Sa of a smallest circle 31 that completely covers the bottom of the hill.

Figure 4:
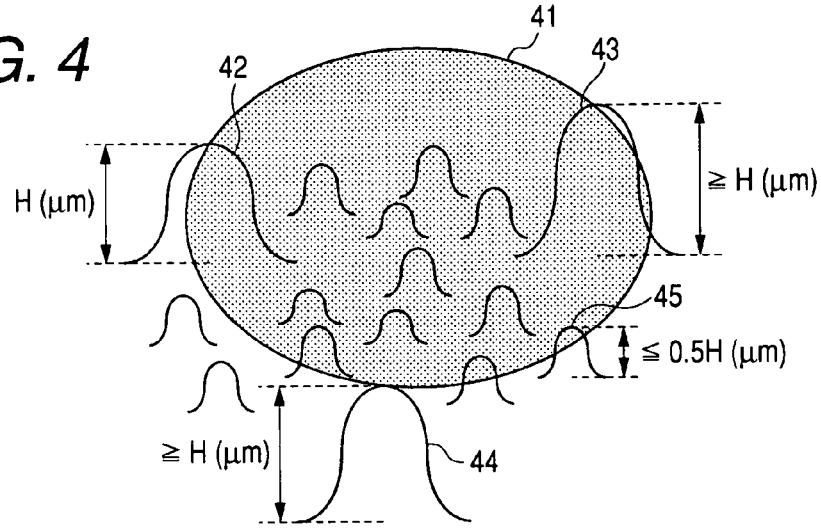
FIG. 4 is a schematic view which illustrates the area Sb ($\mu m^2$) of a region surrounded by hills each having height H (μm) and other hills each having a height of not less than the height of the former hills, and not including any hills having a height of more than 0.5H (μm).

The Sb in the formula (5) is, as shown in FIG. 4, area Sb of a circle 41 that passes all vertexes of hills each having height H (μm) and other hills each having a height of not less than the height of the former hills. In FIG. 4, reference numeral 42 denotes a hill having height H (μm); reference numerals 43 and 44 denote other hills; and reference numeral 45 denotes one of hills having a height 0.5 time or less the height of the hill 42.

In the present invention, the ten-point average surface roughness Rz (μm) of the surface of the charging member may preferably be 2 μm or more, more preferably 4 μm or more, and still more preferably 6 μm or more. If the Rz is too small, it may be difficult to satisfy the charging uniformity. On the other hand, the ten-point average surface roughness Rz (μm) of the surface of the charging member may preferably be 50 μm or less. If the Rz is too large, toner (toner particles or external additives) tends to adhere to the charging member as a result of long-term service to contaminate it or cause non-uniformity of contamination, making it difficult to maintain the initial-stage charging uniformity over a long period of time.

The charging member disclosed in Japanese Patent Application Laid-open No. 2000-214657 is a charging member in which the size of protuberances of its surface (protuberances due to particles present in an atmosphere at the time of production of charging members; the particles being unknown as to the range of particle size distribution and so forth) is defined. However, the invention disclosed in this publication is one intended to smooth the surface of the charging member. Thus, it is difficult for the charging member disclosed in this publication, to satisfy the charging uniformity adapted to the electrophotographic apparatus which can be set to a plurality of different process speeds.

In the invention disclosed in Japanese Patent Application Laid-open No. H07-199593, the surface control of the charging member is the controlling of the surface profile by abrading the surface of a rubber member and shrinking a urethane coating material, and is not the control made by incorporating particles in the cover layer serving as a surface layer of the charging member. Also, the surface control alone as disclosed in Japanese Patent Application Laid-open No. H07-199593 is considered unable to achieve the surface properties of the charging member of the present invention. Thus, it is difficult for the charging member disclosed in Japanese Patent Application Laid-open No. H07-199593, to satisfy the charging uniformity adapted to the electrophotographic apparatus which can be set to a plurality of different process speeds.

The charging member of the present invention is the charging member comprising a support and one or more cover layer(s) provided thereon.

As the cover layer, any layers may be employed which are conventionally known and made up in variety, which may include layers formed of, e.g., resins, rubbers (natural rubbers, which may be subjected to vulcanization treatment, or synthetic rubbers) and elastomers such as thermoplastic elastomers, used as binding materials.

The resins may include fluorine resins, polyamide resins, acrylic resins, polyurethane resins, silicone resins, butyral resins, a styrene-ethylene-butylene-olefin copolymer (SEBC) and an olefin-ethylene-butylene-olefin copolymer (CEBC).

The synthetic rubbers may include an ethylene-propylene-diene copolymer (EPDM), styrene-butadiene copolymer rubber (SBR), silicone rubbers, urethane rubbers, isoprene rubber (IR), butyl rubber (BR), acrylonitrile-butadiene copolymer rubber (NBR), and chloroprene rubber (CR).

The thermoplastic elastomers may include polyolefin type thermoplastic elastomers, urethane type thermoplastic elastomers, polystyrene type thermoplastic elastomers, fluorine rubber type thermoplastic elastomers, polyester type thermoplastic elastomers, polyamide type thermoplastic elastomers, polybutadiene type thermoplastic elastomers, ethylene vinyl acetate type thermoplastic elastomers, polyvinyl chloride type thermoplastic elastomers, and polyethylene chloride type thermoplastic elastomers.

Any of these may be used alone, or two or more may be used in the form of a mixture or a copolymer.

In the charging member of the present invention, two or more cover layers may be provided on the support.

As the support of the charging member, it may at least have conductivity (conductive support). For example, a support made of a metal (or an alloy) such as iron, copper, stainless steel, aluminum or nickel may be used. Also, for the purpose of providing scratch resistance, plating or the like may be applied to the surface of any of these supports as long as its conductivity is not damaged.

Where the charging member is used in the state it is disposed in contact with the electrophotographic photosensitive member, a cover layer having conductivity and elasticity (hereinafter also "elastic cover layer") may preferably be provided between the cover layer serving as a surface layer (hereinafter also "surface cover layer") and the support, from the viewpoint of improving the supply of electricity to that electrophotographic photosensitive member and improving uniform close contact between that electrophotographic photosensitive member and the charging member.

Examples of layer structure of the charging member are shown in FIGS. 5 to 12.

Figure 5:
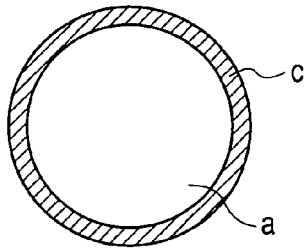
FIG. 5 is a schematic cross-sectional view showing an example of the layer structure of the charging member.

The charging member shown in FIG. 5 is a roller-shaped charging member, and is a charging member of a single-layer structure, having a support a, and a surface cover layer c formed on the support a.

Figure 6:
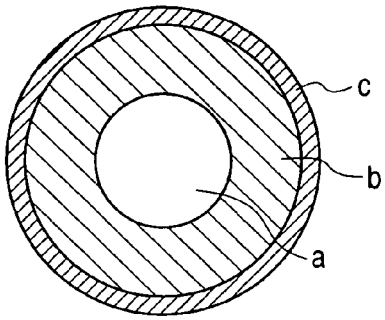
FIG. 6 is a schematic cross-sectional view showing another example of the layer structure of the charging member.

The charging member shown in FIG. 6 is a roller-shaped charging member, and is a charging member of a double-layer structure, having a support a, an elastic cover layer b formed on the support a, and a surface cover layer c formed on the elastic cover layer b.

Figure 7:
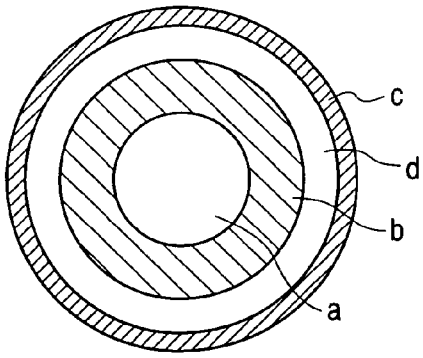
FIG. 7 is a schematic cross-sectional view showing still another example of the layer structure of the charging member.

The charging member shown in FIG. 7 is a roller-shaped charging member, and is a charging member of a triple-layer structure, provided with a resistance layer (a kind of cover layer) d between the elastic cover layer b and the surface cover layer c of the charging member shown in FIG. 6.

Figure 8:
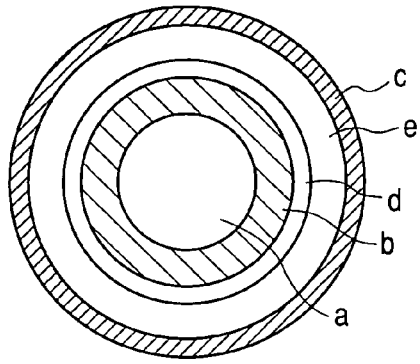
FIG. 8 is a schematic cross-sectional view showing a further example of the layer structure of the charging member.
Figure 9:
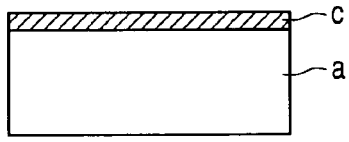
FIG. 9 is a schematic cross-sectional view showing a still further example of the layer structure of the charging member.
Figure 10:
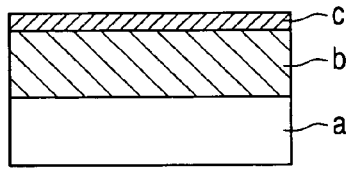
FIG. 10 is a schematic cross-sectional view showing a still further example of the layer structure of the charging member.
Figure 11:
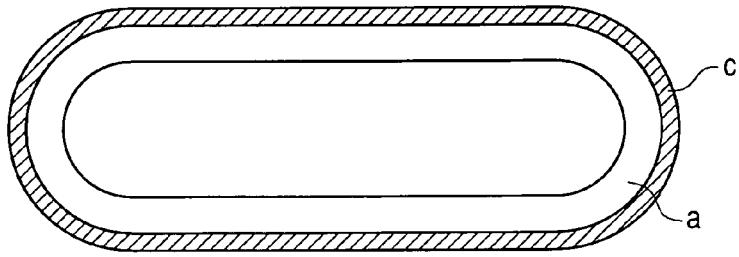
FIG. 11 is a schematic cross-sectional view showing a still further example of the layer structure of the charging member.
Figure 12:
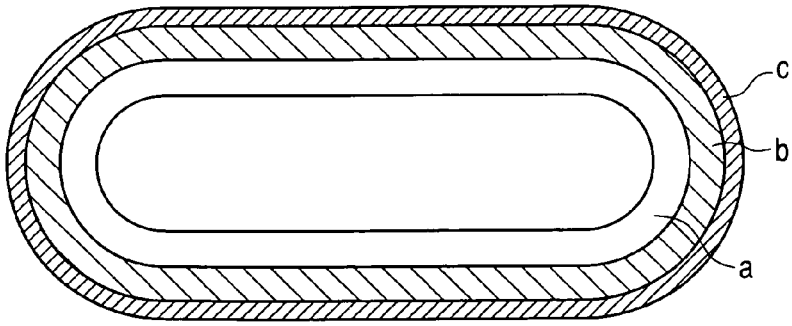
FIG. 12 is a schematic cross-sectional view showing a still further example of the layer structure of the charging member.

The charging member shown in FIG. 8 is a roller-shaped charging member, and is a charging member of a four-layer structure, provided with a second resistance layer (a kind of cover layer) between the resistance layer d and the surface cover layer c of the charging member shown in FIG. 7.

Incidentally, the charging member of the present invention may preferably be the shape of a roller, but may have various shapes such as, as exemplified in FIGS. 9 to 12, the shape of a sheet, the shape of a belt, the shape of a film and the shape of a plate, which may each also have the layer structure described above. In the following, the roller-shaped charging member is called a "charging roller".

The roller-shaped charging member, i.e., the charging roller may be formed in what is called a crown shape, a shape in which the roller is thickest at the middle in its lengthwise direction and is thinner as it comes to both ends in its lengthwise direction. This is preferable from the viewpoint of improving uniform close contact between the charging roller and the electrophotographic photosensitive member. The charging roller commonly comes into contact with the electrophotographic photosensitive member in the state in which a stated pressing force is applied to both ends of the support, where the pressing force is small at the middle in the lengthwise direction and becomes larger toward both ends in the lengthwise direction. Hence, density non-uniformity may occur between images corresponding to the middle and images corresponding to both ends. The crown shape is formed in order to prevent this.

Where the charging member is used in the state it is disposed in contact with the electrophotographic photosensitive member and other members, a material having a high releasability may preferably be used in the surface cover layer so that the electrophotographic photosensitive member and other members are not contaminated. From such a viewpoint, it is preferable to use a resin as the binding material for the surface cover layer.

As methods by which the surface state of the charging member is so controlled as to satisfy the expressions (1) to (5), available are a method in which particles, fibers (such as natural fibers, chemical fibers and glass fiber) or the like are incorporated in the surface cover layer, and a method in which abrasive particles are, or a tape or paper with abrasive particles bonded thereto is, pressed against the surface of the surface cover layer, or abrasive particles are struck against the surface of the surface cover layer (i.e., sand blasting), to abrade the surface of the surface cover layer (i.e., the surface of the charging member). Of these, from the viewpoint of readiness for surface control of the charging member and operation efficiency, preferred is the method in which particles or fibers are incorporated in the surface cover layer, and in particular, the method in which particles are incorporated in the surface cover layer. A method may also be employed in which the above methods are combined, e.g., the particles or fibers are incorporated in the surface cover layer and thereafter the surface of the charging member is abraded.

The particles to be incorporated in the surface cover layer are roughly grouped into conductive particles and insulating particles. In the present invention, the "conductive particles" are meant to be particles having a volume resistivity of $1\times10^{10}$ Ω·cm or less, and the "insulating particles" are meant to be particles having a volume resistivity of more than $1\times10^{10}$ Ω·cm. In the surface cover layer, either of the conductive particles and the insulating particles may be used, or both of them may be used in combination.

The conductive particles may include, e.g., particles of carbon black, tin oxide, titanium oxide, zinc oxide, barium sulfate, copper, aluminum or nickel.

The insulating particles may include, e.g., particles of high-molecular compounds, as exemplified by particles of resins such as polyamide resins, silicone resins, fluorine resins, acrylic or methacrylic resins, styrene resins, phenol resins, polyester resins, melamine resins, urethane resins, olefin resins, epoxy resins, and copolymers, modified products or derivatives of these; particles of rubbers such as an ethylene-propylene-diene copolymer (EPDM), styrene-butadiene copolymer rubber (SBR), silicone rubbers, urethane rubbers, isoprene rubber (IR), butyl rubber (BR), acrylonitrile-butadiene copolymer rubber (NBR), and chloroprene rubber (CR); and particles of thermoplastic elastomers such as polyolefin type thermoplastic elastomers, urethane type thermoplastic elastomers, polystyrene type thermoplastic elastomers, fluorine rubber type thermoplastic elastomers, polyester type thermoplastic elastomers, polyamide type thermoplastic elastomers, polybutadiene type thermoplastic elastomers, ethylene vinyl acetate type thermoplastic elastomers, polyvinyl chloride type thermoplastic elastomers, and polyethylene chloride type thermoplastic elastomers.

Other insulating particles may include particles of metal oxides such as silica, alumina, titanium oxides (such as titanium dioxide and titanium monoxide), zinc oxide, magnesium oxide and zirconium oxide; and particles of barium sulfate, barium titanate, molybdenum disulfide, calcium carbonate, magnesium carbonate, dolomite, talc, kaolin clay, mica, aluminum hydroxide, magnesium hydroxide, zeolite, wollastonite, diatomaceous earth, glass beads, bentonite, montmorillonite, asbestos, hollow glass balloons, graphite, rice hull, organometallic compounds, and organometallic salts.

Also usable are particles of iron oxides such as ferrite, magnetite and hematite, and activated carbon. As the ferrite, it may include, e.g., ferrite described in "Electronic Material Series, Ferrite" (Maruzen Co., Ltd.; published Sep. 10, 1997, Fifth Edition). Stated specifically, $MnFe_2O_4$, $FeFe_2O_4$, $ZnFe_2O_4$, $MgFe_2O_4$ and $\gamma$-$Fe_2O_4$ may be exemplified. The activated carbon may include activated carbon described in "New Edition, Activated Carbon—Basis and Application" (Kodansha Ltd.; published Oct. 20, 1992, Second Edition). Stated specifically, wood activated carbon, coconut shell activated carbon, and coal activated carbon may be exemplified.

Any of these particles may be used alone or in combination of two or more types, and also may be those having been surface-treated, modified, functional-group- or molecular-chain-introduced, or coated. From the viewpoint of controlling the dispersibility of particles, the particles may preferably be subjected to surface treatment. The surface treatment may include, e.g., a coupling treatment and a fatty-acid treatment. The coupling treatment may include, e.g., a treatment making use of a silane coupling agent or a titanate type coupling agent. The fatty-acid treatment may include, e.g., a treatment making use of an acid such as stearic acid.

The surface cover layer may preferably have a volume resistivity of $10^{16}$ Ω·cm or less in an environment of 23° C./50% RH, and may preferably be higher than the volume resistivity of an elastic cover layer described later. If the surface cover layer has too high a volume resistivity, the charging ability required as the charging member may decrease to make it difficult to satisfy the requirement of charging uniformity. If, on the other hand, the surface cover layer has a volume resistivity lower than the volume resistivity of the elastic cover layer described later, it may be difficult to prevent a leak due to pinholes or scratches of the surface of the electrophotographic photosensitive member, which is the member to be charged. In order to control the volume resistivity of the surface cover layer in this way, it is preferable to incorporate one or two or more types of conductive particles in the surface cover layer.

Meanwhile, from the viewpoint of readiness for controlling of dispersibility of particles and furthermore from the viewpoint of readiness for the surface control of the charging member, it is preferable to incorporate high-molecular compound particles (particles composed of at least a high-molecular compound). Especially when the resin preferable as a binding material is used in the surface cover layer, it is preferable to incorporate resin particles (particles composed of at least a resin). Also, of the resin particles, resin particles having the same type of structure as the resin used as a binding material.

Where the above problems are solved by incorporating the particles (preferably the high-molecular compound particles, and more preferably the resin particles) in the surface cover layer of the charging member, the particles to be incorporated in the surface cover layer may preferably have an average particle diameter A (μm) of $2 \leqq A$, more preferably $3 \leqq A$, still more preferably $5 \leqq A$, further preferably $9 \leqq A$, and still further preferably $10 \leqq A$. If the particles to be incorporated in the surface cover layer have too small an average particle diameter, the surface of the charging member may become so smooth as to make it difficult to achieve the charging uniformity adapted to a plurality of different process speeds (or to maintain charging uniformity at the initial stage and charging uniformity over a long period of time). On the other hand, the particles to be incorporated in the surface cover layer may preferably have an average particle diameter A (μm) of $A \leqq 50$, and more preferably $A \leqq 20$. If the particles to be incorporated in the surface cover layer have too large an average particle diameter, hills that are too large may be formed at the surface of the charging member to make it difficult to achieve the charging uniformity adapted to a plurality of different process speeds (or to maintain charging uniformity at the initial stage and charging uniformity over a long period of time).

For the particles to be incorporated in the surface cover layer of the charging member, it is also more preferable to have a sharper particle size distribution. Stated specifically, their particle size distribution, where the average particle diameter is represented by A (μm), may preferably be within the range of from 0 or more to 7 A or less. In other words, the particles to be incorporated in the surface cover layer of the charging member may preferably have particle diameters within the range of from 0 (μm) or more to 7 A (μm) or less. Particles of more than 7 A (μm) in size may form hills that are too large at the surface of the charging member, and may make it difficult to achieve the charging uniformity adapted to a plurality of different process speeds (or to maintain charging uniformity at the initial stage and charging uniformity over a long period of time).

In order to improve the releasability of the surface of the charging member, a lubricant may also be incorporated in the surface cover layer. Incorporation of the lubricant in the surface cover layer enables a reduction of any adhesion of dirt to the surface of the charging member, and hence brings an improvement in running performance of the charging member. It also makes relative movement smooth between the charging member and the electrophotographic photosensitive member, and hence makes any state of irregular movement, such as stick slip, occur less, so that any irregular wear of the surface of the charging member, noise (abnormal sound) and so forth can be kept from occurring. Incidentally, where the lubricant to be incorporated in the surface cover layer is a liquid, it acts also as a leveling agent when the surface cover layer is formed.

As the lubricant, many lubricants are those utilizing low surface energy and those utilizing slidability, and their properties as well are liquid or solid. As those having slidability in solid form (solid lubricants), usable are, e.g., substances described in Solid Lubricant Handbook (publisher: K.K. Saiwai Shobo Co.; published Mar. 15, 1982, Second Edition), which are, stated specifically, metal oxides such as graphite, graphite fluoride, molybdenum disulfide, tungsten disulfide, boron nitride and lead monoxide.

Compounds containing silicon or fluorine in the molecule may also be used in an oil form or a solid form (releasing resin or powder, or a polymer into part of which a moiety having releasability has been introduced). The lubricant may further include waxes and higher fatty acids (inclusive of salts or esters and other derivatives thereof).

The elastic cover layer is, as mentioned above, a cover layer having conductivity and elasticity.

In order to provide the elastic cover layer with elasticity, it is preferable to use as a binding material therefor an elastomer such as a rubber or a thermoplastic elastomer. In particular, from the viewpoint of securing a sufficient nip between the charging member and the electrophotographic photosensitive member, it is more preferable to use a rubber, in particular, a synthetic rubber. A foam obtained by foam-molding the elastomer as a binding material for the elastic cover layer may also be used.

The elasticity or hardness of the elastic cover layer may be controlled by the extent of addition of additives (such as a softening oil and a plasticizer) and the extent of foaming.

Incidentally, the elastic cover layer making use of an elastomer may be formed as the surface layer, i.e., the surface cover layer of the charging member. However, where the additives such as a softening oil and a plasticizer are used, the elastic cover layer may preferably be not the surface layer of the charging member from the viewpoint of preventing the additives from bleading out to the surface of the charging member.

The elastic cover layer may also preferably have a volume resistivity of from $10^5$ to $10^8$ Ω·cm in an environment of 23° C./50% RH. If the elastic cover layer has too high a volume resistivity, the charging ability of the charging member may decrease to make it difficult to satisfy the charging uniformity, to cause an image defect called charging member periodic lengthwise non-uniformity in some cases. If, on the other hand, the elastic cover layer has a too low a volume resistivity, image defects, such as black dots, may occur. If the elastic cover layer has such a too low volume resistivity, it follows that scarcely any potential difference is produced in the elastic cover layer even when a voltage is applied to the charging member. Then, it follows that, where the surface cover layer is specially provided, this potential difference is produced in that surface cover layer. That is, the potential difference Vxy in the elastic cover layer becomes large. In other words, where the surface of the charging member has the same profile, it comes about that, the smaller the volume resistivity the elastic cover layer, the more remarkable the difference in the total sum of ΔQ, i.e., electric charges Q accumulated on the surface of the electrophotographic photosensitive member is, to cause image defects, such as black dots.

One in which only the elastic cover layer has been formed on the support may also preferably have a resistance of from $10^5$ to $10^8$ Ω in an environment of 23° C./50% RH. If it has too high a resistance, it may be difficult to satisfy the charging uniformity requirement, to cause the image defect called charging member periodic lengthwise non-uniformity in some cases. If, on the other hand, it has too low a resistance, image defects, such as black dots, may occur.

The conductivity (volume resistivity) of the elastic cover layer may be controlled by appropriately adding to the above binding material a conducting agent such as carbon black, a conductive metal oxide, an alkali metal salt or an ammonium salt.

In the case when the charging member is made into the charging roller having a crown shape, the elastic cover layer may also preferably be made to have the crown shape by abrading its surface.

As a method for abrading the surface of the elastic cover layer, a method is available in which, e.g., abrasive particles, a tape or paper with abrasive particles bonded thereto, a grinding wheel or the like is/are pressed against the surface of the elastic cover layer. In particular, preferred is the method in which a grinding wheel is pressed against the surface of the elastic cover layer to abrade the surface of the elastic cover layer. As a method for abrading the surface of the roller-shaped elastic cover layer, a method is available that is called a traverse system. This abrasion method, called a traverse system, is a method in which a short-range (small-diameter) grinding wheel is moved along the surface of the roller-shaped elastic cover layer to abrade the surface of the elastic cover layer. As another abrasion method, a method is also available which is called a long-range abrasion system. This abrasion method, called a long-range abrasion system, is a method in which a long-range (large-diameter) grinding wheel, i.e., a grinding wheel having a range that is substantially the same as the lengthwise size of the roller-shaped elastic cover layer is used, which is once pressed against the surface of the elastic cover layer, whereby the surface of the elastic cover layer can be abraded in a very short time. This abrasion method, called a long-range abrasion system, enables one-time abrasion of the surface of the elastic cover layer. Hence, the surface roughness of the elastic cover layer can be put to the desired value with ease only by controlling the surface profile of the grinding wheel.

In the case when the additives are used in the elastic cover layer, one or two or more resistance layer(s) (a kind of cover layer) may also be provided between the elastic cover layer and the surface cover layer, from the viewpoint of firmly preventing the additives from bleeding out. The resistance layer may preferably have a volume resistivity higher than the volume resistivity of the elastic cover layer and lower than the volume resistivity of the surface cover layer. If the resistance layer has a volume resistivity lower than the volume resistivity of the elastic cover layer or higher than the volume resistivity of the surface cover layer, it is difficult to satisfy the charging uniformity requirement. In order to control the volume resistivity of the resistance layer in this way, one or two or more types of conductive particles may be incorporated in the resistance layer.

In addition to the above various materials, materials having various functions may also appropriately be incorporated in the above surface cover layer, elastic cover layer and resistance layer. Such materials may include, e.g., antioxidants such as 2-mercaptobenzimidazole, and other lubricants such as stearic acid and zinc stearate.

The surfaces of the above surface cover layer, elastic cover layer and resistance layer may also be subjected to surface treatment. The surface treatment may include, e.g., a surface working treatment making use of ultraviolet rays or electron rays, and a surface modification treatment in which a compound is made to adhere to the surface and/or the latter is impregnated with the former.

The above surface cover layer, elastic cover layer and resistance layer may be formed by bonding to the support, or covering the support with, a sheet-shaped or tube-shaped layer formed beforehand in a stated thickness, or by coating, such as electrostatic spray coating or dip coating. A method may also be used in which the layer is roughly formed by extrusion and is thereafter shape-adjusted by abrasion or the like, or a method may still also be used in which a material is cured and molded in a mold into a stated shape.

In the case when the layer is formed by coating, as the solvent used in a coating solution, any solvent may suffice as long as it is capable of dissolving the binding material. For example, it may include alcohols such as methanol, ethanol and isopropanol; ketones such as acetone, methyl ethyl ketone and cyclohexanone; amides such as N,N-dimethylformamide and N,N-dimethylacetamide; sulfoxides such as dimethyl sulfoxide; ethers such as tetrahydrofuran, dioxane, and ethylene glycol monomethyl ether; esters such as methyl acetate and ethyl acetate; aliphatic halogenated hydrocarbons such as chloroform, ethylene chloride, dichloroethylene, carbon tetrachloride, and trichloroethylene; and aromatic compounds such as benzene, toluene, xylene, ligroine, chlorobenzene and dichlorobenzene.

The above surface cover layer, elastic cover layer and resistance layer may also have any thickness as long as it is within the range that does not damage the function the respective layers have. Stated specifically, the surface cover layer may preferably have a layer thickness of from 1 μm to 1,000 μm, the elastic cover layer may preferably have a layer thickness of 0.5 mm or more, and the resistance layer may preferably have a layer thickness of from 1 μm to 1,000 μm. If the surface cover layer has a too small layer thickness, the non-uniformity of thickness of the layer may remarkably appear, or the unevenness of the elastic cover layer may come appeared as it is, to the surface of the charging member. In such a case, it is difficult to satisfy the charging uniformity, and also the toner (toner particles and external additives) tends to adhere to the surface of the charging member. If the surface cover layer has a too large layer thickness, the elasticity of the elastic cover layer may insufficiently be brought out, and the uniform close contact between the electrophotographic photosensitive member and the charging member may become poor. If the elastic cover layer has too small a layer thickness, the layer may have an insufficient elasticity, and the uniform close contact between the electrophotographic photosensitive member and the charging member may become poor.

(Methods for Measurement of Physical Properties)

In the present invention, the volume resistivity of the above surface cover layer, elastic cover layer and resistance layer is measured in an environment of 23° C./50% RH, using a resistance measuring instrument HIRESTA-UP, manufactured by Mitsubishi Chemical Corporation, and under application of a voltage of 250 V for 30 seconds to a measurement object sample. To measure the volume resistivity of the elastic cover layer, a layer of 2 mm in thickness is formed using the materials for the elastic cover layer, and this is used as the measurement object sample. To measure the volume resistivity of the resistance layer, an aluminum sheet is coated thereon with a coating solution containing the materials for the resistance layer, and the coating formed is used as the measurement object sample.

Figure 13:
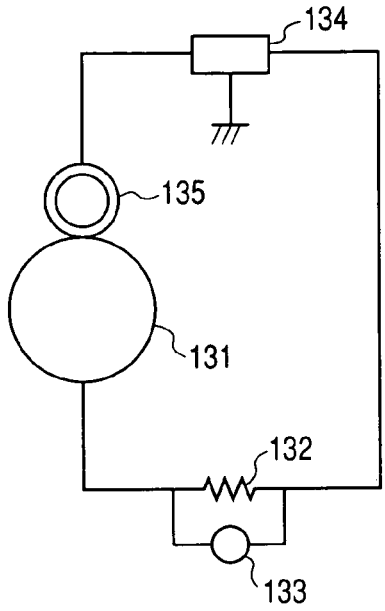
FIG. 13 is a schematic view showing the construction of a device for measuring the resistivity of an elastic coat layer formed member.

The resistance of the one in which only the elastic cover layer has been formed on the support is measured with a measuring instrument constituted of, as shown in FIG. 13, a 30 mm diameter cylindrical electrode 131 made of stainless steel, a fixed resistometer 132, a recording device (recorder) 133, a power source 134 and so forth. A member 135 in which only the elastic cover layer has been formed on the support is pressed at both its both ends against the cylindrical electrode 131 under a load of 500 g each, 1 kg in total, and the resistance is measured rotating the member 135 in which only the elastic cover layer has been formed on the support and the cylindrical electrode 131. In the environment of 23° C./50% RH, values of electric current flowing in the circuit when a voltage of 200 V is applied from the power source 134 are measured, and the resistance of the member 135 in which only the elastic cover layer has been formed on the support is calculated from their average value.

In the present invention, the layer thickness of the above surface cover layer, elastic cover layer and resistance layer each is also examined by cutting the charging member with a knife or the like, observing the cross section of the layer on an optical microscope or an electron microscope, and measuring its thickness.

The ten-point average surface roughness (Rz) is the ten-point average surface roughness according to the standard of JIS B 0601 surface roughness. It is measured with a surface roughness measuring instrument SE-3400, manufactured by Kosaka Laboratory Ltd. Stated in detail, the ten-point average surface roughness is measured with this measuring instrument at 6 spots at random on the measurement object charging member, and an average value of the measurements at 6 spots is regarded as the ten-point average surface roughness (Rz). Also, surface hill-to-valley average distance (SM) is measured in the same manner as the ten-point average surface roughness (Rz).

The H, Sa and Sb described above are also measured with an ultradepth profile measuring microscope VK-8500, manufactured by KEYENCE CORPORATION. Stated in detail, the charging member is placed on a stage, and hills of the surface of the charging member are picked, which are then measured in a measuring mode of "Color Ultradepth". After the measurement, a profile or a measured screen may be displayed to calculate height and area. How to calculate is as described previously.

The charging member of the present invention, the surface state of which has been so controlled as to satisfy the expressions (1) to (5), is summarized below.

In regard to hills at 20 spots of the surface of a charging member which have been picked at random from among regions used in image formation (i.e., the hills each having the height H (μm) that satisfies the expressions (2) and (3) in relation to the Rz), the H, Sa and Sb are calculated, and the H, Sa and Sb thus calculated and the ten-point average surface roughness Rz of the surface of the charging member all do not deviate from the expressions (1) to (5), in the case of which the charging member is the charging member of the present invention.

If hill-like ones not satisfying the expression (3) are present in the regions used in image formation, they are too small to be taken into account as the hills whose area Sa is calculated, and also too small to be employed as "vertexes" for calculating the area Sb in the expression (5).

The charging member of the present invention, the surface state of which has been so controlled as to satisfy the expressions (1) to (5) has, in the regions used in image formation, no hill-like one (hill) which is so large as not to satisfy the expression (2).

The area Sb is not calculated where, setting as a standard a certain one hill of the hills each having the height H (μm) that satisfies the expressions (2) and (3) in relation to the Rz, any other hills having a height of not less than the height of the hill set as the standard are not present, or where only one hill is present, or where, even if two or more hills are present, any hills having a height of more than 0.5 time the height of the the hill set as the standard are unwantedly present on the inside of a region surrounded by their vertexes and the vertex of the hill set as the standard.

In the present invention, the particle diameter of the particles is also measured with a laser diffraction particle size distribution measuring instrument SALD-7000, manufactured by Shimadzu Corporation. First, a solution is prepared by adding to distilled water a surface-active agent in an amount of as small as 0.2% by weight. This surface-active agent is not particularly limited, and any surface-active agent may be used. This solution is put into a glass bottle, and measurement object particles are put into it and dispersed by applying ultrasonic waves for 5 minutes. The resultant dispersion is put into a measuring cell to measure particle diameters. Measurable particle diameters range from 0.015 μm to 500 μm. Also, volume-average particle diameter measured with the above instrument is regarded as the average particle diameter of the particles.

In the present invention, the volume resistivity of the insulating particles is also measured in an environment of 23° C./50% RH, using a resistance measuring instrument HIRESTA-UP, manufactured by Mitsubishi Chemical Corporation, and under application of a voltage to a measurement object sample; the voltage being adapted to the resistance of the measurement object sample (because the preferable voltage to be applied differs depending on regions where the resistance is to be measured). The volume resistivity of the conductive particles is also measured in an environment of 23° C./50% RH, using a resistance measuring instrument LORESTA-GP, manufactured by Mitsubishi Chemical Corporation, and under application of a voltage of 10 V to the measurement object sample.

The amount of the measurement object sample to be used may preferably appropriately be controlled taking account of the density of particles on which the volume resistivity is to be measured (volume resistivity, measurement object particles). For example, when that of tin oxide particles is measured, 1.5 g of the particles are used. Also, when that of carbon black is measured, 0.5 g of the carbon black is used, and then a pressure of 10.1 MPa (102 kgf/cm$^2$) is applied thereto to compact it, and the compact powder obtained is used as the measurement object sample.

Figure 14:
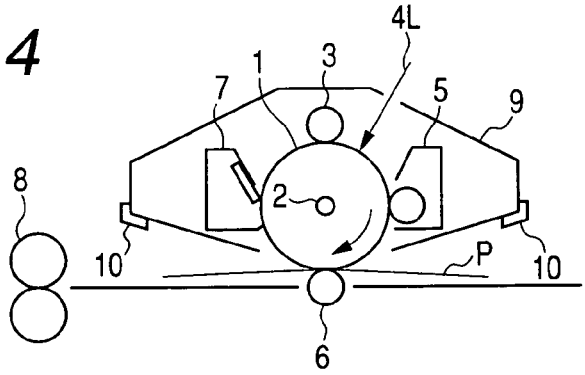
FIG. 14 is a schematic view showing an example of the construction of an electrophotographic apparatus provided with a process cartridge having an electrophotographic photosensitive member and the charging member of the present invention.

An example of the construction of an electrophotographic apparatus provided with a process cartridge having an electrophotographic photosensitive member and the charging member of the present invention is schematically shown in FIG. 14.

In FIG. 14, reference numeral 1 denotes a cylindrical electrophotographic photosensitive member, which is rotatingly driven around an axis 2 in the direction of an arrow at a stated peripheral speed.

The surface of the electrophotographic photosensitive member 1 being rotatingly driven is uniformly electrostatically charged to a positive or negative, given potential through a charging means (in FIG. 14, a roller-shaped charging member, i.e., a charging roller) 3. The electrophotographic photosensitive member thus charged is then exposed to exposure light 4L emitted from an exposure means (not shown) for slit exposure or laser beam scanning exposure. In this way, electrostatic latent images corresponding to the intended image are successively formed on the surface of the electrophotographic photosensitive member 1.

The electrostatic latent images thus formed on the surface of the electrophotographic photosensitive member 1 are developed with a toner contained in a developer in a developing means 5 to become toner images. The toner images thus formed and held on the surface of the electrophotographic photosensitive member 1 are then successively transferred by the aid of a transfer bias given from a transfer means 6; being transferred to a transfer material (such as paper) P fed from a transfer material feed means (not shown) to the part between the electrophotographic photosensitive member 1 and the transfer means 6 in the manner synchronized with the rotation of the electrophotographic photosensitive member 1.

The transfer material P to which the toner images have been transferred is separated from the surface of the electrophotographic photosensitive member, is guided into a fixing means 8, where the toner images are fixed, and is then put out of the apparatus as an image-formed material (a print or a copy).

The surface of the electrophotographic photosensitive member 1 from which images have been transferred is subjected to removal of the developer (toner) remaining after the transfer, through a cleaning means (such as a cleaning blade) 7. Thus the electrophotographic photosensitive member is cleaned on its surface, and then repeatedly used for the formation of images. Incidentally, after the surface of the electrophotographic photosensitive member has been cleaned by the cleaning means 7, the surface of the electrophotographic photosensitive member 1 may be subjected to charge elimination by pre-exposure light before it is charged by the charging member 3.

The apparatus may be constituted of a combination of plural components held in a housing and integrally joined as a process cartridge from among the constituents such as the above electrophotographic photosensitive member 1, charging member 3, developing means 5, transfer means 6 and cleaning means 7 so that the process cartridge is detachably mountable to the main body of the electrophotographic apparatus, such as a copying machine or a laser beam printer. In what is shown in FIG. 14, the electrophotographic photosensitive member 1, the primary charging means 3, the developing means 5 and the cleaning means 7 are integrally supported in the cartridge to form a process cartridge 9 that is detachably mountable to the main body of the apparatus through a guide means 10 such as rails provided in the main body of the electrophotographic apparatus.

As the electrophotographic photosensitive member 1, an electrophotographic photosensitive member may be employed which comprises a cylindrical support (conductive support) and formed on the support a photosensitive layer containing an inorganic photosensitive material and/or an organic photosensitive material. The electrophotographic photosensitive member 1 may also further have a charge injection layer for making the surface of the electrophotographic photosensitive member charged to the stated polarity and potential.

As a developing system the developing means 3 may employ, it may include, e.g., a jumping developing system, a contact developing system and a magnetic brush system. In the case of an electrophotographic apparatus which reproduces color images (full-color images), the contact developing system is particularly preferred for the purpose of remedying the scattering disposition of toners.

EXAMPLES

The present invention is described below in greater detail by giving Examples. Note, however, that the present invention is by no means limited to these Examples. In the following Examples, "part(s)" is meant to be "part(s) by weight".

Example 1

A cylinder of 6 mm in diameter and 232 mm in length, made of stainless-steel was used as a support (conductive support).

Next, 100 parts of an epichlorohydrin rubber terpolymer (epichlorohydrin : ethylene oxide : allylglycidyl ether=40 mol %:56 mol %:4 mol %), 30 parts of light-duty calcium carbonate, 5 parts of an aliphatic polyester type plasticizer, 1 part of zinc stearate, 0.5 part of 2-mercaptobenzimidazole (MB) (an antioxidant), 5 parts of zinc oxide, 2 parts of a quaternary ammonium salt represented by the following formula:

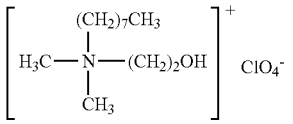

and 5 parts of carbon black (a surface-untreated product; average particle diameter: 0.2 μm; volume resistivity: 0.1 Ω·cm) were kneaded for 10 minutes by means of an enclosed mixer controlled to 50° C., to prepare a raw-material compound.

To this raw-material compound, based on the weight of the epichlorohydrin rubber terpolymer, 1% by weight of sulfur (a vulcanizing agent), 1% by weight of dibenzothiazyl sulfide (DM) (a vulcanization accelerator) and 0.5% by weight of tetramethylthiuram monosulfide (TS) were added, and these were kneaded for 10 minutes by means of a twin-roll mill kept cooled to 20° C., to obtain a compound for elastic cover layer.

This compound for the elastic cover layer was extruded onto the support by means of an extruder and was so formed as to have the shape of a roller of 15 mm in outer diameter, and then subjected to superheated-steam vulcanization, followed by surface abrasion working which was so carried out as to have the shape of a roller of 10 mm in outer diameter. Thus, an elastic cover layer was formed on the support. For this abrasion working, the long-range abrasion system was employed.

The volume resistivity of the elastic cover layer and the resistance of "the one in which only the elastic cover layer was formed on the support" (hereinafter "elastic cover layer formed member") were measured by the methods described previously, to find that the volume resistivity of the elastic cover layer was $1.2\times10^{6}$ Ω·cm and the resistance of the elastic cover layer formed member was $3.2\times10^{5}$ Ω.

Next, 100 parts of a caprolactone modified acryl-polyol solution, 250 parts of methyl isobutyl ketone, 130 parts of conductive tin oxide particles (trifluoropropyltrimethoxysilane-treated product; average particle diameter: 0.05 μm; volume resistivity: $10^{3}$ Ω·cm; conductive particles), 3 parts of hydrophobic silica particles (dimethylpolysiloxane-treated product; average particle diameter: 0.02 μm; volume resistivity: $10^{16}$ Ω·cm), 0.08 part of modified dimethylsilicone oil and 80 parts of cross-linked polymethyl methacrylate (PMMA) particles (average particle diameter: 9.85 μm; largest-particle particle diameter: 52.5 μm; volume resistivity: $10^{16}$ Ω·cm; insulating high-molecular compound particles (resin particles)) were put into a glass bottle to prepare a liquid mixture.

In this liquid mixture, as dispersion media, glass beads of 0.8 mm in average particle diameter were so packed as to be in a packing of 80%, followed by dispersion for 18 hours using a paint shaker dispersion machine to obtain a liquid dispersion.

To this liquid dispersion, a 1:1 mixture of hexamethylene diisocyanate (HDI) and isophorone diisocyanate (IPDI) each blocked with butanone oxime was so added as to be NCO/OH=1.0 to prepare a surface cover layer coating fluid.

This surface cover layer coating fluid was dip-coated twice on the elastic cover layer, followed by air drying at normal temperature for 30 minutes or more, subsequently drying for 1 hour by means of a circulating hot-air dryer set to 80° C., and further drying for 1 hour by means of a circulating hot-air dryer set to 160° C. to form a surface cover layer on the elastic cover layer. Here, the dip coating was carried out in the following way.

That is, after first-time dip coating was carried out, the wet coating formed was dried for 10 to 30 minutes at normal temperature. Then, the member coated was reversed, and second-time dip coating was carried out in the same manner as the first-time dip coating. The draw-up rate was set to 6 mm/second on both the first time and the second time.

A charging roller was thus produced, having on the support the elastic cover layer and the surface cover layer in this order.

The volume resistivity of the surface cover layer was measured by the method described previously, to find that the volume resistivity of the surface cover layer was $10^{10}$ Ω·cm. The ten-point average surface roughness (Rz) was also measured by the method described previously, to find that it was 10.2 μm.

The results of each measurement on the above are shown in Table 1.

The H, Sa and Sb were also calculated by the method described previously, with respect to 20 hills picked at random. The results of measurement are shown in Table 2.

Evaluation

Figure 15:
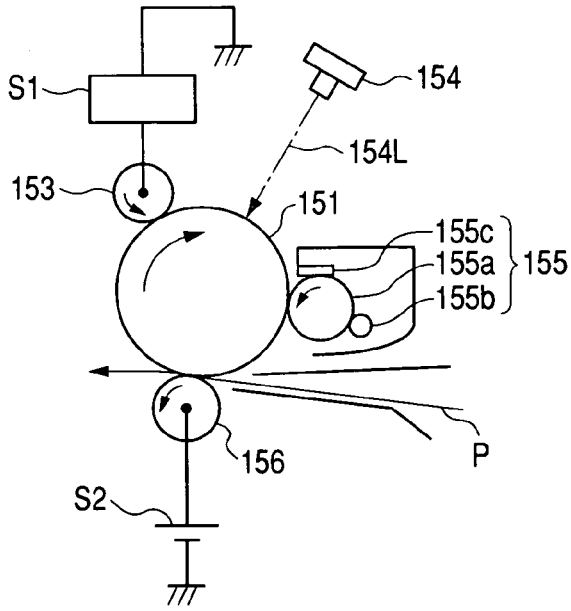
FIG. 15 is a schematic view showing the construction of an electrophotographic apparatus used in Examples and Comparative Examples.

1. Evaluation of Reproduced Images at Initial Stage:

The charging member produced was set in an electrophotographic apparatus constructed as shown in FIG. 15 (only DC voltage was applied to the charging member), and halftone images were reproduced in each of a normal-temperature and normal-humidity environment of 23° C./50% RH (hereinafter "N/N environment"), a high-temperature and high-humidity environment of 30° C./80% RH (hereinafter "H/H environment") and a low-temperature and low-humidity environment of 15° C./10% RH (hereinafter "L/L environment"), and reproduced images were evaluated. Here, the voltage applied to the charging member was so controlled for each environment that the surface potential (dark-area potential) VD of the electrophotographic photosensitive member having been charged by the charging member was −400 V in each environment. Also, the process speed was set to two kinds, 94 mm/second and 30 mm/second.

The electrophotographic apparatus constructed as shown in FIG. 15 is described below.

Reference numeral 151 denotes a cylindrical electrophotographic photosensitive member. This electrophotographic photosensitive member 151 is rotatingly driven in the direction of an arrow at a stated process speed (able to be set to 94 mm/second and 30 mm/second).

Reference numeral 153 denotes a charging roller. S1 denotes a power source for applying a voltage of only DC voltage to the charging roller. The charging roller 153 is kept in contact (touch) with the electrophotographic photosensitive member 151 at a stated pressing force, and is rotatingly driven in the direction following the rotation of the electrophotographic photosensitive member 151. To this charging roller 153, a voltage of only DC voltage of −1,000 V is applied from the power source S1, whereby the surface of the electrophotographic photosensitive member 151 is charged (contact-charged) to −400 V.

Reference numeral 154 denotes a laser beam scanner as an exposure means. The surface of the electrophotographic photosensitive member 151 kept charged to −400 V (dark-area potential) by the charging roller 153 is irradiated with exposure (imagewise exposure) light 154L corresponding to the intended image information, by means of the laser beam scanner 154, whereby the potential of −400 V of the surface of the electrophotographic photosensitive member is selectively attenuated to −150V (light-area potential), so that an electrostatic latent image is formed on the surface of the electrophotographic photosensitive member 151.

Reference numeral 155 denotes a developing assembly (developing means). The developing assembly 155 has a toner carrying member 155*a* which is provided at an opening of a developer container holding a toner (developer) and carries and transports the toner thereon, an agitation member 155*b* which agitates the toner held in the developer container, and a toner control member 155*c* which controls the quantity of the toner held on the toner carrying member 155*a* (i.e., toner layer thickness). In the developing assembly 155, a toner (a negative toner) standing charged electrostatically to −350 V (development bias) is made to adhere selectively to light-area potential areas of the electrostatic latent image formed on the surface of the electrophotographic photosensitive member 151 to render the electrostatic latent image visible as a toner image. The toner carrying member 155*a* is in contact with the electrophotographic photosensitive member 151, or in contact with the electrophotographic photosensitive member 151 via the toner being carried. That is, it employs the contact developing system. Accordingly, the toner carrying member 155*a* is, from the viewpoint of securing contact stability, made a developing roller comprising a conductive support and provided thereon with an elastic cover layer (made of a rubber) endowed with conductivity. Of course, in the elastic cover layer, a foam may be used as an elastic material, or an additional layer may be provided on the elastic cover layer, or the elastic cover layer may be subjected to surface treatment, such as a surface working treatment making use of ultraviolet rays or electron rays, and surface modification treatment in which a compound is made to adhere to the surface and/or the latter is impregnated with the former.

Reference numeral 156 denotes a transfer roller as a transfer means. The transfer roller 156 is a transfer roller having a conductive support and covered thereon with an elastic resin layer controlled to medium resistance. The transfer roller 156 is kept in contact with the electrophotographic photosensitive member 151 under a stated pressing force to form a transfer nip between them, and is rotated in the direction following the rotation of the electrophotographic photosensitive member 151 at a peripheral speed substantially equal to the rotational peripheral speed of the electrophotographic photosensitive member 151. Also, a transfer voltage having the polarity opposite to the charge characteristics of the toner is applied from a power source S2. A transfer material P is fed at a stated timing from a paper feed mechanism section (not shown) to the transfer nip, and is charged on its back, to the polarity opposite to the charge polarity of the toner by means of a transfer roller 156 to which a transfer voltage is kept applied, whereby the toner image on the surface of the electrophotographic photosensitive member 151 is electrostatically transferred to the surface (the side facing the electrophotographic photosensitive member 151) of the transfer material P at the transfer nip.

The transfer material P to which the toner image has been transferred at the transfer nip is separated from the surface of the electrophotographic photosensitive member 151, and is guided into a toner image fixing means (not shown), where the toner image is subjected to fixing. Then the image-fixed transfer material is put out as an image-formed matter. In the case of a double-side image-forming mode or a multiple-image-forming mode, this image-formed matter is guided into a recirculation delivery mechanism (not shown) and is again guided to the transfer nip.

Transfer residual toner on the surface of the electrophotographic photosensitive member 151 is collected therefrom by a cleaning means (not shown). Thereafter, the surface of the electrophotographic photosensitive member 151 is again electrostatically charged by the charging roller 153, and images are repeatedly formed thereon.

The results of evaluation of initial-stage reproduced images are shown in Table 3. In Table 3, image levels are ranked as follows: Rank 1: very good; Rank 2: good; Rank 3: line-like or dot-like image defects are slightly seen on halftone images; and Rank 4: line-like or dot-like image defects are conspicuous.

Among images reproduced at the process speed of 94 mm/second and images reproduced at the process speed of 30 mm/second, the evaluation rank of a poorer image level was used as the evaluation rank of Examples (and Comparative Examples).

2. Evaluation of Reproduced Images in Running Test:

After the reproduced images at the initial stage were evaluated, a continuous 10,000-sheet image reproduction running test was conducted in each environment. During the running test, the process speed was set to 94 mm/second. During the running test, reproduced images on the 5,000th sheet and 10,000th sheet were evaluated. This evaluation of reproduced images was made in the same manner as the evaluation of reproduced images at the initial stage.

The results of evaluation of reproduced images after running (5,000th sheet and 10,000th sheet) are shown in Table 4. In Table 4, image levels are ranked as follows: Rank 1: no changes from initial-stage reproduced images; Rank 2: little changes from initial-stage reproduced images (slight density non-uniformity is seen); Rank 3: slight density non-uniformity and dots which are caused by non-uniform contamination of the charging member appear on halftone images; and Rank 4: density non-uniformity and dots which are caused by non-uniform contamination of the charging member appear on halftone images. Among images reproduced at the process speed of 94 mm/second and images reproduced at the process speed of 30 mm/second, the evaluation rank of a poorer image level was used as the evaluation rank of Examples (and Comparative Examples).

Example 2

A charging member was produced in the same manner as in Example 1 except that the cross-linked polymethyl methacrylate (PMMA) particles to be incorporated in the surface cover layer were used in an amount changed to 50 parts instead of 80 parts. Here, the average particle diameter and largest-particle particle diameter of the cross-linked polymethyl methacrylate (PMMA) particles incorporated in the surface cover layer were as shown in Table 1.

On the charging member thus produced, the volume resistivity of the elastic cover layer, the resistance of the elastic cover layer formed member, the volume resistivity of the surface cover layer and the Rz, H, Sa and Sb of the surface of the charging member were measured in the same manner as those of the charging member produced in Example 1, to obtain the results shown in Tables 1 and 2.

Using the charging member produced, reproduced images at the initial stage and after running were also evaluated in the same manner as in Example 1. The results of evaluation are shown in Tables 3 and 4.

Example 3

A charging member was produced in the same manner as in Example 1 except that the cross-linked polymethyl methacrylate (PMMA) particles to be incorporated in the surface cover layer were changed for polystyrene particles, which were used in an amount changed to 50 parts. The average particle diameter and largest-particle particle diameter of the polystyrene particles incorporated in the surface cover layer were as shown in Table 1.

On the charging member thus produced, the volume resistivity of the elastic cover layer, the resistance of the elastic cover layer formed member, the volume resistivity of the surface cover layer and the Rz, H, Sa and Sb of the surface of the charging member were measured in the same manner as those of the charging member produced in Example 1, to obtain the results shown in Tables 1 and 2.

Using the charging member produced, reproduced images at the initial stage and after running were also evaluated in the same manner as in Example 1. The results of evaluation are shown in Tables 3 and 4.

Example 4

A charging member was produced in the same manner as in Example 3, and its surface was abraded to obtain a charging member of this Example. As an abrasion method, a method was employed in which a sheet of paper to the surface of which aluminum oxide particles (abrasive particles) of 5.2 μn in average particle diameter were bonded was pressed against the abrasion object (the charging member produced in the same manner as in Example 3) being rotated.

On the charging member thus produced, the volume resistivity of the elastic cover layer, the resistance of the elastic cover layer formed member, the volume resistivity of the surface cover layer and the Rz, H, Sa and Sb of the surface of the charging member were measured in the same manner as those of the charging member produced in Example 1, to obtain the results shown in Tables 1 and 2.

Using the charging member produced, reproduced images at the initial stage and after running were also evaluated in the same manner as in Example 1. The results of evaluation are shown in Tables 3 and 4.

Example 5

A charging member was produced in the same manner as in Example 2 except that the elastic cover layer was formed in the following way.

That is, 100 parts of acrylonitrile-butadiene copolymer rubber (NBR), 5 parts of carbon black (a surface-untreated product; average particle diameter: 0.2 μm; volume resistivity: 0.1 Ω·cm), 2 parts of the same quaternary ammonium salt as that used in the elastic cover layer of the charging member of Example 1, 30 parts of calcium carbonate, 5 parts of zinc oxide and 2 parts of an aliphatic polyester (a plasticizer) were kneaded for 10 minutes by means of an enclosed mixer controlled to 50° C., and these were further kneaded for 20 minutes by means of an enclosed mixer kept cooled to 20° C., to obtain a raw-material compound.

To this raw-material compound, based on the weight of the NBR, 1% by weight of sulfur and 3% by weight of NOCCELER TS (available from Ouchi-Shinko Chemical Industrial Co., Ltd.) were added, and these were kneaded for 10 minutes by means of a twin-roll mill kept cooled to 50° C., to obtain a compound for elastic cover layer.

This compound for elastic cover layer was extruded onto the support by means of an extruder and was so formed as to have the shape of a roller of 15 mm in outer diameter, which was then vulcanized by heating and formed, followed by surface abrasion working which was so carried out as to have the shape of a roller of 10 mm in outer diameter. Thus, an elastic cover layer was formed on the support. For this abrasion working, the long-range abrasion system was employed.

The volume resistivity of the elastic cover layer and the resistance of elastic cover layer formed member were measured by the methods described previously, to find that the volume resistivity of the elastic cover layer was $2.3\times10^6$ Ω·cm and the resistance of the elastic cover layer formed member was $7.8\times10^5$ Ω.

On the charging member thus produced, the volume resistivity of the elastic cover layer, the resistance of the elastic cover layer formed member, the volume resistivity of the surface cover layer and the Rz, H, Sa and Sb of the surface of the charging member were measured in the same manner as those of the charging member produced in Example 1, to obtain the results shown in Tables 1 and 2.

Using the charging member produced, reproduced images at the initial stage and after running were also evaluated in the same manner as in Example 1. The results of evaluation are shown in Tables 3 and 4.

Example 6

A charging member was produced in the same manner as in Example 2 except that the quaternary ammonium salt to be incorporated in the elastic cover layer was used in an amount changed to 5 parts instead of 2 parts and the carbon black was used in an amount changed to 10 parts instead of 5 parts.

The volume resistivity of the elastic cover layer and the resistance of elastic cover layer formed member were measured by the methods described previously, to find that the volume resistivity of the elastic cover layer was $1.25\times10^5$ Ω·cm and the resistance of the elastic cover layer formed member was $1.02\times10^5$ Ω.

On the charging member thus produced, the volume resistivity of the elastic cover layer, the resistance of the elastic cover layer formed member, the volume resistivity of the surface cover layer and the Rz, H, Sa and Sb of the surface of the charging member were measured in the same manner as those of the charging member produced in Example 1, to obtain the results shown in Tables 1 and 2.

Using the charging member produced, reproduced images at the initial stage and after running were also evaluated in the same manner as in Example 1. The results of evaluation are shown in Tables 3 and 4.

Example 7

A charging member was produced in the same manner as in Example 2 except that the quaternary ammonium salt to be incorporated in the elastic cover layer was used in an amount changed to 0.1 part instead of 2 parts and the carbon black was used in an amount changed to 1 parts instead of 5 parts.

The volume resistivity of the elastic cover layer and the resistance of elastic cover layer formed member were measured by the methods described previously, to find that the volume resistivity of the elastic cover layer was $6.5\times10^7$ Ω·cm and the resistance of the elastic cover layer formed member was $5.6\times10^7$ Ω.

On the charging member thus produced, the volume resistivity of the elastic cover layer, the resistance of the elastic cover layer formed member, the volume resistivity of the surface cover layer and the Rz, H, Sa and Sb of the surface of the charging member were measured in the same manner as those of the charging member produced in Example 1, to obtain the results shown in Tables 1 and 2.

Using the charging member produced, reproduced images at the initial stage and after running were also evaluated in the same manner as in Example 1. The results of evaluation are shown in Tables 3 and 4.

Example 8

A charging member was produced in the same manner as in Example 7.

Using the charging member produced, reproduced images at the initial stage and after running were also evaluated in the same manner as in Example 1 except that, of the two different process speeds, the low-side 30 mm/second was changed to 47 mm/second. The results of evaluation are shown in Tables 3 and 4.

Example 9

A charging member was produced in the same manner as in Example 7.

Using the charging member produced, reproduced images at the initial stage and after running were also evaluated in the same manner as in Example 1 except that, of the two different process speeds, the low-side 30 mm/second was changed to 15 mm/second. The results of evaluation are shown in Tables 3 and 4.

Comparative Example 1

A charging member was produced in the same manner as in Example 5 except that the cross-linked polymethyl methacrylate (PMMA) particles to be incorporated in the surface cover layer were used in an amount changed to 0 part instead of 50 parts (namely, not used).

On the charging member thus produced, the volume resistivity of the elastic cover layer, the resistance of the elastic cover layer formed member, the volume resistivity of the surface cover layer and the Rz of the surface of the charging member were measured in the same manner as those of the charging member produced in Example 1, to obtain the results shown in Table 1. The H for which the Sa and Sb are to be calculated was not present in the charging member of this example.

Using the charging member produced, reproduced images at the initial stage and after running were also evaluated in the same manner as in Example 1. The results of evaluation are shown in Tables 3 and 4.

In this example, lines had appeared in the reproduced images. Hills which might have caused dots on the reproduced images were not present at the surface of the charging member.

Comparative Example 2

A charging member was produced in the same manner as in Example 5 except that the cross-linked polymethyl methacrylate (PMMA) particles to be incorporated in the surface cover layer had the average particle diameter and largest-particle particle diameter as shown in Table 1.

On the charging member thus produced, the volume resistivity of the elastic cover layer, the resistance of the elastic cover layer formed member, the volume resistivity of the surface cover layer and the Rz, H, Sa and Sb of the surface of the charging member were measured in the same manner as those of the charging member produced in Example 1, to obtain the results shown in Tables 1 and 2.

Using the charging member produced, reproduced images at the initial stage and after running were also evaluated in the same manner as in Example 1. The results of evaluation are shown in Tables 3 and 4.

In this example, conspicuous dots appeared on the reproduced images. Also, image defects caused by non-uniform contamination of the surface of the charging member appeared during the running test.

Comparative Example 3

A charging member was produced in the same manner as in Example 5 except that the cross-linked polymethyl methacrylate (PMMA) particles to be incorporated in the surface cover layer had the average particle diameter and largest-particle particle diameter as shown in Table 1.

On the charging member thus produced, the volume resistivity of the elastic cover layer, the resistance of the elastic cover layer formed member, the volume resistivity of the surface cover layer and the Rz, H, Sa and Sb of the surface of the charging member were measured in the same manner as those of the charging member produced in Example 1, to obtain the results shown in Tables 1 and 2.

Using the charging member produced, reproduced images at the initial stage and after running were also evaluated in the same manner as in Example 1. The results of evaluation are shown in Tables 3 and 4.

In this example, dots appeared on the reproduced images. Also, image defects caused by non-uniform contamination of the surface of the charging member appeared during the running test.

Comparative Example 4

A charging member was produced in the same manner as in Example 5 except that the cross-linked polymethyl methacrylate (PMMA) particles to be incorporated in the surface cover layer had the average particle diameter and largest-particle particle diameter as shown in Table 1.

On the charging member thus produced, the volume resistivity of the elastic cover layer, the resistance of the elastic cover layer formed member, the volume resistivity of the surface cover layer and the Rz, H, Sa and Sb of the surface of the charging member were measured in the same manner as those of the charging member produced in Example 1, to obtain the results shown in Tables 1 and 2.

Using the charging member produced, reproduced images at the initial stage and after running were also evaluated in the same manner as in Example 1. The results of evaluation are shown in Tables 3 and 4.

In this example, dots appeared on the reproduced images. Also, image defects caused by non-uniform contamination of the surface of the charging member appeared during the running test.

Comparative Example 5

A charging member was produced in the same manner as in Example 5 except that the cross-linked polymethyl methacrylate (PMMA) particles to be incorporated in the surface cover layer had the average particle diameter and largest-particle particle diameter as shown in Table 1.

On the charging member thus produced, the volume resistivity of the elastic cover layer, the resistance of the elastic cover layer formed member, the volume resistivity of the surface cover layer and the Rz, H, Sa and Sb of the surface of the charging member were measured in the same manner as those of the charging member produced in Example 1, to obtain the results shown in Tables 1 and 2.

Using the charging member produced, reproduced images at the initial stage and after running were also evaluated in the same manner as in Example 1. The results of evaluation are shown in Tables 3 and 4.

In this example, dots appeared on the reproduced images. Also, image defects caused by non-uniform contamination of the surface of the charging member appeared during the running test.

TABLE 1

| | Charging member surface, ten-point average surface roughness Rz (μm) | Resin particles in surface cover layer: Average particle diameter (μm) | Resin particles in surface cover layer: Largest particle diameter (μm) | Elastic cover layer, volume resistivity (Ω · cm) | Elastic cover layer formed member, resistance (Ω) |
|---|---|---|---|---|---|
| Example 1 | 10.2 | 9.85 | 52.5 | $1.2 \times 10^6$ | $3.2 \times 10^5$ |
| Example 2 | 20.2 | 19.56 | 130.5 | $1.2 \times 10^6$ | $3.2 \times 10^5$ |
| Example 3 | 50 | 49.8 | 120.6 | $1.2 \times 10^6$ | $3.2 \times 10^5$ |
| Example 4 | 21.5 | 49.8 | 120.6 | $1.2 \times 10^6$ | $3.2 \times 10^5$ |
| Example 5 | 21.5 | 19.56 | 130.5 | $1.2 \times 10^6$ | $7.8 \times 10^5$ |
| Example 6 | 22.1 | 19.56 | 130.5 | $1.25 \times 10^5$ | $1.02 \times 10^5$ |
| Example 7 | 19.8 | 19.56 | 130.5 | $6.5 \times 10^7$ | $5.6 \times 10^7$ |
| Example 8 | 20.5 | 19.56 | 130.5 | $6.5 \times 10^7$ | $5.6 \times 10^7$ |
| Example 9 | 19.2 | 19.56 | 130.5 | $6.5 \times 10^7$ | $5.6 \times 10^7$ |
| Comparative Example 1 | 1.86 | — | — | $2.3 \times 10^6$ | $7.8 \times 10^5$ |
| Comparative Example 2 | 61.2 | 62.3 | 437.2 | $2.3 \times 10^6$ | $7.8 \times 10^5$ |
| Comparative Example 3 | 11.2 | 11.3 | 82.3 | $2.3 \times 10^6$ | $7.8 \times 10^5$ |
| Comparative Example 4 | 2.89 | 2.58 | 20.3 | $2.3 \times 10^6$ | $7.8 \times 10^5$ |
| Comparative Example 5 | 21.6 | 20.12 | 143.2 | $2.3 \times 10^6$ | $7.8 \times 10^5$ |

TABLE 2

| H (μm) | Sa ($\mu m^2$) | Sb ($\mu m^2$) |
|---|---|---|
| | Example 1 | |
| 25 | 8,000 | 8,110 |
| 10.3 | 1,020 | 800 |
| 10 | 780 | 15,008 |
| 12 | 9,150 | 10,360 |
| 9.8 | 820 | 3,600 |
| 15 | 1,010 | 5,000 |
| 11 | 1,500 | 1,434 |
| 13.2 | 2,000 | 8,212 |
| 16.5 | 3,120 | 12,001 |
| 9.6 | 910 | 3,839 |
| 10 | 2,001 | 2,631 |
| 18 | 10,000 | 6,000 |
| 17.1 | 6,780 | 1,902 |
| 22 | 9,160 | 5,612 |
| 10.1 | 2,620 | 2,316 |
| 12.5 | 5,680 | 8,213 |
| 9.9 | 600 | 7,451 |
| 10.7 | 370 | 1,063 |
| 11.5 | 3,418 | 1,200 |
| 10.8 | 521 | 6,000 |
| | Example 2 | |
| 20 | 10,236 | 12,356 |
| 40.2 | 13,001 | 6,000 |
| 18 | 9,812 | 10,025 |
| 20 | 12,612 | 5,002 |
| 13 | 810 | 7,008 |
| 21.2 | 4,880 | 11,634 |
| 22.5 | 2,215 | 10,118 |
| 26.8 | 8,916 | 9,215 |
| 30.1 | 6,213 | 9,787 |
| 32.1 | 10,063 | 6,742 |
| 25.8 | 10,125 | 10,001 |
| 23.1 | 6,084 | 10,343 |
| 19.6 | 5,216 | 10,592 |
| 15.8 | 11,325 | 12,100 |
| 29.7 | 7,210 | 7,215 |
| 38.5 | 12,153 | 6,231 |
| 39.6 | 9,821 | 6,821 |
| 21.6 | 5,000 | 3,257 |
| 27.3 | 10,112 | 10,117 |
| 26.4 | 5,124 | 9,615 |

TABLE 2-continued

| H (μm) | Sa ($\mu m^2$) | Sb ($\mu m^2$) |
|---|---|---|
| | Example 3 | |
| 50 | 5,310 | 1,400 |
| 48 | 13,561 | 4,123 |
| 46 | 6,215 | 1,600 |
| 35 | 7,814 | 2,056 |
| 32 | 12,631 | 7,814 |
| 45.1 | 10,591 | 4,815 |
| 46.1 | 5,263 | 3,212 |
| 37.5 | 9,001 | 2,163 |
| 40.6 | 9,825 | 5,000 |
| 42.1 | 2,001 | 2,112 |
| 52.2 | 12,314 | 1,613 |
| 53.6 | 10,001 | 2,135 |
| 42.3 | 8,213 | 3,267 |
| 46.8 | 7,465 | 1,157 |
| 39.5 | 3,001 | 6,211 |
| 38.2 | 14,352 | 2,431 |
| 51.5 | 2,121 | 3,133 |
| 50.2 | 3,478 | 2,114 |
| 53.1 | 6,913 | 1,601 |
| 50 | 5,267 | 1,211 |
| | Example 4 | |
| 40.5 | 9,502 | 5,012 |
| 13.4 | 10,115 | 12,585 |
| 20.5 | 2,412 | 10,118 |
| 18.2 | 3,618 | 10,109 |
| 19.6 | 5,215 | 8,215 |
| 21.2 | 7,812 | 12,634 |
| 36.8 | 10,123 | 7,913 |
| 32.1 | 11,965 | 8,014 |
| 34.5 | 12,113 | 6,012 |
| 19.3 | 9,121 | 5,013 |
| 15.6 | 1,368 | 4,912 |
| 39.1 | 4,321 | 6,968 |
| 16.1 | 6,512 | 12,134 |
| 18.1 | 12,568 | 9,714 |
| 27.8 | 10,012 | 10,012 |
| 24.1 | 11,136 | 9,299 |
| 22.5 | 11,965 | 6,321 |
| 20.1 | 8,679 | 5,432 |
| 19.1 | 9,852 | 10,112 |
| 18.2 | 1,016 | 2,143 |

TABLE 2-continued

| H (μm) | Sa ($\mu m^2$) | Sb ($\mu m^2$) |
|---|---|---|
| | Example 5 | |
| 35.6 | 10,036 | 7,912 |
| 14.2 | 4,211 | 15,230 |
| 20.6 | 8,918 | 10,163 |
| 19.8 | 10,012 | 7,864 |
| 32.3 | 4,756 | 6,248 |
| 25.6 | 6,213 | 11,123 |
| 22.1 | 3,432 | 12,159 |
| 21.3 | 8,921 | 10,929 |
| 25.6 | 10,123 | 9,570 |
| 23.4 | 12,140 | 4,726 |
| 15.8 | 10,015 | 8,213 |
| 17.9 | 9,874 | 6,214 |
| 28.1 | 2,123 | 9,268 |
| 27.1 | 4,265 | 8,136 |
| 20.9 | 3,214 | 10,170 |
| 18.1 | 5,814 | 10,152 |
| 20.5 | 10,921 | 11,634 |
| 21.9 | 8,937 | 9,213 |
| 26.3 | 9,045 | 8,152 |
| 20 | 12,140 | 7,638 |
| | Example 6 | |
| 39.6 | 12,506 | 6,012 |
| 16.5 | 5,214 | 17,251 |
| 12.6 | 3,218 | 20,112 |
| 25.2 | 11,365 | 10,963 |
| 31.3 | 9,821 | 9,215 |
| 28.9 | 8,325 | 8,761 |
| 15.3 | 2,159 | 15,621 |
| 18.9 | 9,218 | 12,134 |
| 20.2 | 8,143 | 10,156 |
| 30.5 | 7,659 | 9,213 |
| 34.2 | 11,245 | 7,214 |
| 40.9 | 5,213 | 5,924 |
| 21.2 | 6,121 | 12,111 |
| 20.3 | 5,431 | 9,215 |
| 19.2 | 8,724 | 8,613 |
| 25.6 | 9,658 | 4,215 |
| 20.4 | 10,145 | 9,813 |
| 23.2 | 1,963 | 5,214 |
| 18.5 | 4,258 | 15,111 |
| 20.8 | 1,216 | 12,638 |
| | Example 7 | |
| 40.2 | 11,365 | 5,215 |
| 15.6 | 867 | 16,230 |
| 18.6 | 6,813 | 10,621 |
| 20.5 | 7,421 | 10,121 |
| 19.2 | 2,159 | 9,581 |
| 23.6 | 8,214 | 12,153 |
| 29.6 | 11,526 | 3,215 |
| 25.4 | 3,412 | 4,321 |
| 32.5 | 2,115 | 8,756 |
| 38.4 | 10,682 | 6,125 |
| 35.9 | 11,258 | 8,225 |
| 16.4 | 1,432 | 10,156 |
| 13.2 | 6,521 | 4,218 |
| 19.5 | 8,215 | 3,215 |
| 26.8 | 1,468 | 9,521 |
| 27.1 | 2,351 | 4,321 |
| 38.4 | 6,218 | 6,921 |
| 32.1 | 2,121 | 7,856 |
| 29.9 | 4,120 | 9,213 |
| 15.2 | 980 | 15,681 |
| | Example 8 | |
| 18.9 | 1,025 | 5,263 |
| 20.3 | 5,685 | 10,265 |
| 29.6 | 8,525 | 9,854 |
| 33.5 | 1,231 | 8,563 |
| 32.1 | 10,265 | 5,632 |
| 21.4 | 10,251 | 8,756 |
| 25.6 | 11,258 | 5,623 |
| 40.2 | 10,026 | 6,856 |

TABLE 2-continued

| H (μm) | Sa ($\mu m^2$) | Sb ($\mu m^2$) |
|---|---|---|
| 39.5 | 6,852 | 5,421 |
| 16.5 | 2,341 | 2,356 |
| 14.2 | 1,456 | 8,954 |
| 18.9 | 2,561 | 10,123 |
| 17.2 | 1,052 | 9,854 |
| 16.5 | 3,685 | 2,365 |
| 23.1 | 4,563 | 11,256 |
| 22.4 | 10,156 | 10,231 |
| 17.9 | 9,857 | 9,857 |
| 30.2 | 6,534 | 2,145 |
| 32.5 | 4,893 | 4,213 |
| 13.5 | 2,156 | 10,256 |
| | Example 9 | |
| 19.3 | 10,365 | 6,542 |
| 18.2 | 11,036 | 4,785 |
| 13.5 | 8,945 | 12,563 |
| 20.5 | 7,851 | 4,052 |
| 25.6 | 10,256 | 10,452 |
| 23.4 | 11,256 | 9,854 |
| 32.5 | 2,354 | 5,874 |
| 30.2 | 11,324 | 4,652 |
| 40.3 | 8,574 | 4,256 |
| 39.5 | 2,135 | 5,587 |
| 14.5 | 2,356 | 5,642 |
| 16.5 | 1,123 | 10,112 |
| 24.1 | 5,634 | 8,523 |
| 38.2 | 2,156 | 2,345 |
| 22.1 | 8,956 | 3,985 |
| 20.3 | 10,245 | 2,974 |
| 18.6 | 9,854 | 7,584 |
| 17.6 | 10,365 | 6,482 |
| 15.2 | 3,521 | 10,265 |
| 13.4 | 4,658 | 10,451 |
| | Comparative Example 2 | |
| 61.2 | 17,265 | 8,215 |
| 53.2 | 15,634 | 8,562 |
| 101.5 | 21,561 | 14,352 |
| 215.6 | 32,165 | 7,451 |
| 63.5 | 12,631 | 3,450 |
| 53.1 | 19,591 | 4,253 |
| 48.1 | 9,842 | 12,563 |
| 64.5 | 21,561 | 18,212 |
| 86.5 | 23,425 | 9,852 |
| 78.5 | 18,921 | 4,521 |
| 52.1 | 16,182 | 10,212 |
| 51.1 | 15,821 | 12,568 |
| 69.2 | 15,963 | 9,235 |
| 58.1 | 19,215 | 8,212 |
| 57.2 | 15,235 | 6,041 |
| 54.3 | 9,825 | 2,512 |
| 45.6 | 9,285 | 8,216 |
| 62.5 | 10,185 | 11,421 |
| 78.5 | 9,045 | 2,121 |
| 96.2 | 10,000 | 1,015 |
| | Comparative Example 3 | |
| 40.5 | 12,512 | 7,852 |
| 30.5 | 15,231 | 11,925 |
| 43.8 | 10,256 | 7,921 |
| 11.56 | 10,952 | 23,560 |
| 10.6 | 9,215 | 39,563 |
| 21.5 | 8,125 | 15,113 |
| 11.25 | 10,153 | 19,812 |
| 11.1 | 12,001 | 9,215 |
| 10.9 | 18,921 | 3,413 |
| 28.2 | 17,631 | 12,568 |
| 61.2 | 15,124 | 4,513 |
| 11.2 | 9,215 | 9,118 |
| 10.9 | 7,312 | 5,612 |
| 13.5 | 2,115 | 4,215 |
| 15.6 | 1,065 | 8,213 |
| 11.3 | 892 | 9,156 |
| 12.8 | 4,125 | 12,634 |
| 20.5 | 10,921 | 16,213 |

TABLE 2-continued

| H (μm) | Sa ($\mu m^2$) | Sb ($\mu m^2$) |
|---|---|---|
| 18.9 | 8,215 | 18,212 |
| 11.7 | 1,563 | 11,531 |
| | Comparative Example 4 | |
| 17.23 | 10,268 | 21,563 |
| 14.3 | 12,365 | 21,153 |
| 18.2 | 7,956 | 17,921 |
| 8.3 | 3,921 | 26,521 |
| 8 | 1,018 | 28,520 |
| 8.9 | 7,651 | 25,631 |
| 9.2 | 4,325 | 23,134 |
| 11.5 | 3,234 | 22,098 |
| 12.6 | 542 | 10,151 |
| 13.5 | 6,385 | 12,368 |
| 18.2 | 2,143 | 17,856 |
| 7.63 | 1,015 | 10,965 |
| 9.23 | 10,125 | 21,321 |
| 9.21 | 10,158 | 25,313 |
| 8.92 | 921 | 20,246 |
| 12.45 | 8,543 | 10,153 |
| 19.15 | 6,214 | 18,263 |
| 16.21 | 856 | 21,011 |
| 20.54 | 3,251 | 19,365 |
| 21.2 | 2,854 | 18,215 |
| | Comparative Example 5 | |
| 50.2 | 15,263 | 10,156 |
| 38.56 | 16,235 | 23,563 |
| 52.6 | 10,320 | 15,634 |
| 14.6 | 563 | 20,569 |
| 13.5 | 321 | 26,329 |
| 60.3 | 16,213 | 21,534 |
| 80.2 | 21,531 | 26,521 |
| 21.5 | 9,251 | 15,812 |
| 20.3 | 8,213 | 17,634 |
| 19.8 | 4,215 | 15,213 |
| 18.3 | 6,348 | 20,152 |
| 16.2 | 10,159 | 21,563 |
| 15.4 | 821 | 18,215 |
| 32.1 | 1,421 | 16,321 |
| 38.5 | 15,923 | 8,641 |
| 25.6 | 4,156 | 9,215 |
| 28.9 | 9,213 | 10,653 |
| 19.2 | 16,532 | 9,854 |
| 26.3 | 982 | 13,652 |
| 30.3 | 1,015 | 15,632 |

TABLE 3

| | Evaluation of reproduced images at initial stage | | | | | |
|---|---|---|---|---|---|---|
| | Lines Environment | | | Dots Environment | | |
| | N/N | H/H | L/L | N/N | H/H | L/L |
| Example 1 | 1 | 1 | 1 | 1 | 1 | 1 |
| Example 2 | 1 | 1 | 1 | 2 | 2 | 1 |
| Example 3 | 1 | 1 | 1 | 2 | 2 | 2 |
| Example 4 | 1 | 1 | 1 | 2 | 3 | 1 |
| Example 5 | 1 | 1 | 1 | 2 | 2 | 1 |
| Example 6 | 1 | 1 | 1 | 3 | 3 | 2 |
| Example 7 | 2 | 2 | 3 | 2 | 2 | 1 |
| Example 8 | 2 | 2 | 3 | 1 | 2 | 1 |
| Example 9 | 3 | 2 | 3 | 1 | 2 | 1 |
| Comparactive Example 1 | 4 | 4 | 4 | 1 | 2 | 1 |
| Comparactive Example 2 | 2 | 1 | 3 | 3 | 4 | 2 |
| Comparactive Example 3 | 2 | 2 | 3 | 4 | 4 | 3 |

TABLE 3-continued

| | Evaluation of reproduced images at initial stage | | | | | |
|---|---|---|---|---|---|---|
| | Lines Environment | | | Dots Environment | | |
| | N/N | H/H | L/L | N/N | H/H | L/L |
| Comparactive Example 4 | 3 | 2 | 3 | 4 | 4 | 4 |
| Comparactive Example 5 | 2 | 2 | 2 | 4 | 4 | 3 |

TABLE 4

| | Evaluation of reproduced images during running test | | | | | |
|---|---|---|---|---|---|---|
| | N/N Environment | | H/H Environment | | L/L Environment | |
| | 5,000th sheet | $10^4$th sheet | 5,000th sheet | $10^4$th sheet | 5,000th sheet | $10^4$th sheet |
| Example 1 | 1 | 1 | 1 | 1 | 1 | 1 |
| Example 2 | 2 | 2 | 2 | 2 | 2 | 2 |
| Example 3 | 2 | 3 | 3 | 3 | 2 | 3 |
| Example 4 | 2 | 2 | 2 | 3 | 2 | 2 |
| Example 5 | 2 | 2 | 2 | 3 | 2 | 3 |
| Example 6 | 2 | 2 | 2 | 2 | 2 | 3 |
| Example 7 | 2 | 2 | 2 | 3 | 2 | 2 |
| Example 8 | 2 | 2 | 2 | 2 | 2 | 3 |
| Example 9 | 2 | 2 | 2 | 2 | 3 | 3 |
| Comparactive Example 1 | 2 | 3 | 2 | 2 | 3 | 4 |
| Comparactive Example 2 | 4 | 4 | 4 | 4 | 4 | 4 |
| Comparactive Example 3 | 3 | 4 | 3 | 4 | 3 | 4 |
| Comparactive Example 4 | 3 | 4 | 3 | 4 | 3 | 4 |
| Comparactive Example 5 | 3 | 4 | 4 | 4 | 3 | 4 |

Figure 16:
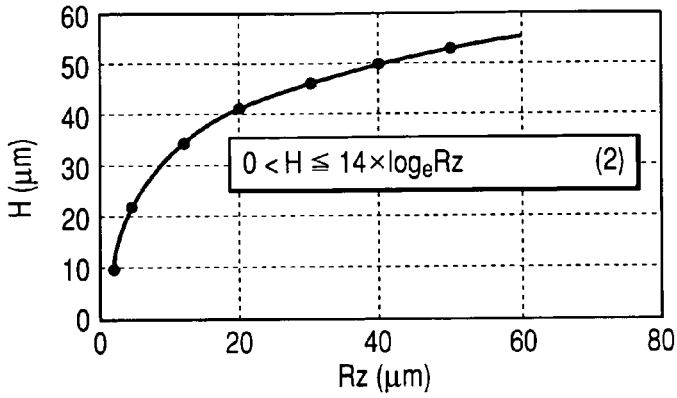
FIG. 16 is a graph of the formula (2).
Figure 17:
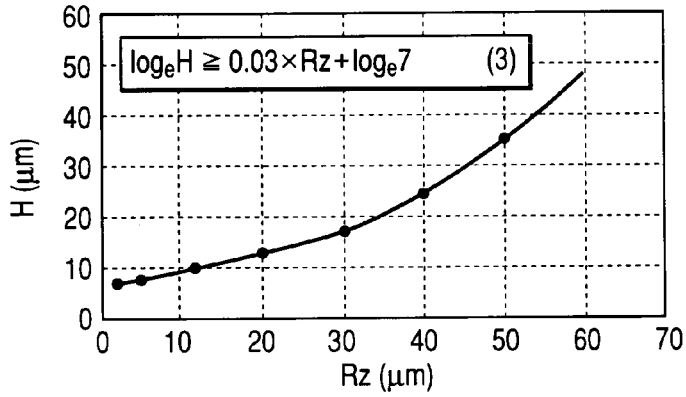
FIG. 17 is a graph of the formula (3).
Figure 18:
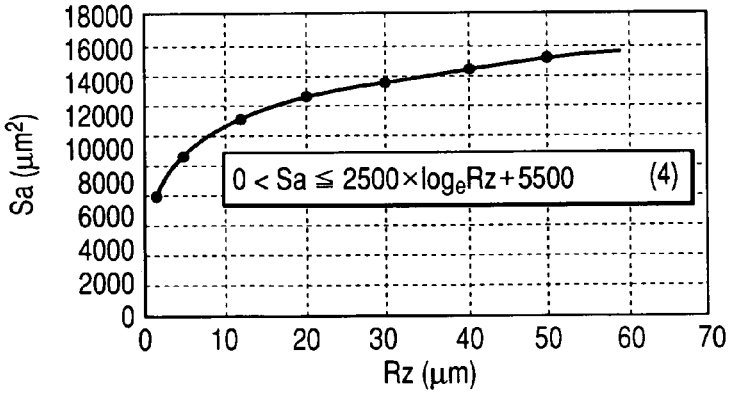
FIG. 18 is a graph of the formula (4).
Figure 19:
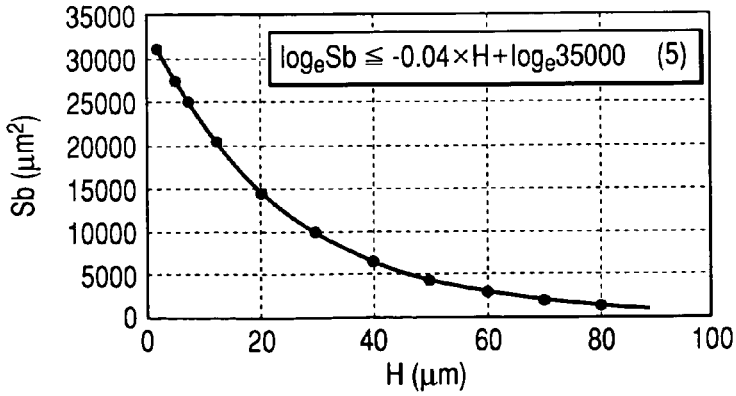
FIG. 19 is a graph of the formula (5).

A graph of the formula (2) is shown in FIG. 16, a graph of the formula (3) in FIG. 17, a graph of the formula (4) in FIG. 18, and a graph of the formula (5) in FIG. 19.

According to the present invention, a charging member can be provided that enables reproduction of good images free of any image defects (in particular, with horizontal lines kept from occurring), even when the electrophotographic apparatus to be used is the electrophotographic apparatus which can be set to a plurality of different process speeds, and also a process cartridge and an electrophotographic apparatus which have such a charging member can be provided.

What is claimed is:

1. A charging member comprising a support and one or more cover layers thereon, wherein, where the ten-point average surface roughness of the surface of said charging member is represented by Rz in units of μm, Rz satisfies the expression (1):

$$2 \leqq Rz \leqq 50 \quad (1);$$

an area Sa in units of $\mu m^2$ at the part of a hill of the surface of said charging member, having a height H in units of μm that satisfies the expressions (2) and (3) in relation to the Rz:

$$H \leqq 14 \times \log_e Rz \quad (2); \text{ and}$$

$$\log_e H \geqq 0.03 \times Rz + \log_e 7 \quad (3);$$

satisfies the expression (4):

$$0<Sa\leqq 2{,}500\times\log_e Rz+5{,}500 \quad (4);\text{ and}$$

an area Sb in units of $\mu m^2$ of a region of the surface of said charging member, surrounded by hills each having the height H in units of μm that satisfies the expressions (2) and (3) in relation to Rz and other hills each having a height of not less than the height of the former hills, and not including on the inside thereof any hills having a height of more than 0.5 times the height of the former hills, satisfies the expression (5):

$$\log_e Sb\leqq -0.04\times H+\log_e 35{,}000 \quad (5).$$

2. The charging member according to claim 1, wherein one of said cover layers is a surface layer of said charging member and contains high-molecular compound particles.

3. The charging member according to claim 2, wherein said high-molecular compound particles comprise a resin.

4. The charging member according to claim 2, wherein when the average particle diameter of said high-molecular compound particles is represented by A in units of μm, the range of particle size distribution of said high-molecular compound particles is more than 0 μm to 7 A or less.

5. The charging member according to claim 2, wherein, where the average particle diameter of said high-molecular compound particles is represented by A in units of μm, $2\leqq A\leqq 50$.

6. The charging member according to claim 2, wherein, where the average particle diameter of said high-molecular compound particles is represented by A in units of μm, $3\leqq A$.

7. The charging member according to claim 2, wherein, where the average particle diameter of said high-molecular compound particles is represented by A in units of μm, $5\leqq A$.

8. The charging member according to claim 2, wherein, where the average particle diameter of said high-molecular compound particles is represented by A in units of μm, $9\leqq A$.

9. The charging member according to claim 2, wherein, where the average particle diameter of said high-molecular compound particles is represented by A in units of μm, $10\leqq A$.

10. The charging member according to claim 1, wherein said charging member has two or more cover layers.

11. The charging member according to claim 10, wherein said charging member comprises a plurality of said cover layers comprising a surface layer and a layer right beneath said cover layer serving as the surface layer of said charging member, wherein said layer right beneath said cover layer serving as the surface layer has a volume resistivity of from $10^5$ Ω·cm to $10^8$ Ω·cm in an environment of 23° C./50% RH.

12. A charging member comprising a support and one or more cover layers thereon, wherein one of said cover layers serves as a surface layer of said charging member containing high-molecular compound particles and, where the average particle diameter of said high-molecular compound particles is represented by A in units of μm, $2\leqq A\leqq 50$, and the range of particle size distribution of said high-molecular compound particles is more than 0 μm to 7 A μm or less.

13. The charging member according to claim 12, wherein said high-molecular compound particles comprise a resin.

14. The charging member according to claim 12, wherein $3\leqq A$.

15. The charging member according to claim 12, wherein $5\leqq A$.

16. The charging member according to claim 12, wherein $9\leqq A$.

17. The charging member according to claim 12, wherein $10\leqq A$.

18. The charging member according to claim 12, wherein said charging member has are two or more cover layers.

19. The charging member according to claim 18, wherein said charging member comprises a plurality of said cover layers comprising a surface layer and a layer right beneath said cover layer serving as the surface layer of said charging member, wherein said layer right beneath said cover layer serving as the surface layer has a volume resistivity of from $10^5$ Ω·cm to $10^8$ Ω·cm in an environment of 23° C./50% RH.

20. A process cartridge comprising:

an electrophotographic photosensitive member and a charging member which are integrally supported, and being detachably mountable to the main body of an electrophotographic apparatus, said charging member comprising:

a support; and one or more cover layers, wherein:

where the ten-point average surface roughness of the surface of said charging member is represented by Rz in units of μm, Rz satisfies the expression (1):

$$2\leqq Rz\leqq 50 \quad (1);$$

an area Sa in units of $\mu m^2$ at the part of a hill of the surface of said charging member, having a height H in units of μm that satisfies the expressions (2) and (3) in relation to the Rz:

$$H\leqq 14\times\log_e Rz \quad (2);\text{ and}$$

$$\log_e H\geqq 0.03\times Rz+\log_e 7 \quad (3);$$

satisfies the expression (4):

$$0<Sa\leqq 2{,}500\times\log_e Rz+5{,}500 \quad (4);\text{ and}$$

an area Sb in units of $\mu m^2$ of a region of the surface of said charging member, surrounded by hills each having the height H in units of μm that satisfies the expressions (2) and (3) in relation to the Rz and other hills each having a height of not less than the height of the former hills, and not including on the inside thereof any hills having a height of more than 0.5 times the height of the former hills, satisfies the expression (5):

$$\log_e Sb\leqq -0.04\times H+\log_e 35{,}000 \quad (5).$$

21. A process cartridge comprising an electrophotographic photosensitive member and a charging member which are integrally supported, and being detachably mountable to the main body of an electrophotographic apparatus;

said charging member comprising:

a support; and one or more cover layers, wherein one of said cover layers serves as a surface layer of said charging member containing high-molecular compound particles and, where the average particle diameter of said high-molecular compound particles is represented by A in units of μm, $2\leqq A\leqq 50$, and the range of particle size distribution of said high-molecular compound particles is more than 0 μm to 7 A μm or less.

22. An electrophotographic apparatus comprising:

an electrophotographic photosensitive member;

a charging device;

an exposure device;

a developing device; and a transfer device, said charging device comprising a charging member comprising:

a support; and one or more cover layers, wherein:

where the ten-point average surface roughness of the surface of said charging member is represented by Rz in units of μm, Rz satisfies the expression (1):

$$2 \leqq Rz \leqq 50 \quad (1);$$

an area Sb in units of $\mu m^2$ at the part of a hill of the surface of said charging member, having a height H in units of μm that satisfies the expressions (2) and (3) in relation to the Rz:

$$H \leqq 14 \times \log_e Rz \quad (2); \text{ and}$$

$$\log_e H \geqq 0.03 \times Rz + \log_e 7 \quad (3);$$

satisfies the expression (4):

$$0 < Sa \leqq 2{,}500 \times \log_e Rz + 5{,}500 \quad (4); \text{ and}$$

an area Sb in units of $\mu m^2$ of a region of the surface of said charging member, surrounded by hills each having the height H in units of μm that satisfies the expressions (2) and (3) in relation to Rz and other hills each having a height of not less than the height of the former hills, and not including on the inside thereof any hills having a height of more than 0.5 times the height of the former hills, satisfies the expression (5):

$$\log_e Sb \leqq -0.04 \times H + \log_e 35{,}000 \quad (5).$$

23. The electrophotographic apparatus according to claim 22, further comprising voltage application means for applying to said charging member a voltage of only a direct-current voltage.

24. The electrophotographic apparatus according to claim 22, further comprising process speed control means by which said electrophotographic photosensitive member is drivable at two or more different process speeds.

25. An electrophotographic apparatus comprising:

an electrophotographic photosensitive member;

a charging device;

an exposure device;

a developing device; and a transfer device;

said charging device comprising a charging member comprising:

a support; and one or more cover layers, wherein one of said cover layers serves as a surface layer of said charging member containing high-molecular compound particles and, where the average particle diameter of said high-molecular compound particles is represented by A in units of μm, $2 \leqq A \leqq 50$, and the range of particle size distribution of said high-molecular compound particles is more than 0 μm to 7 A μm or less.

26. The electrophotographic apparatus according to claim 25, further comprising voltage application means for applying to said charging member a voltage of only a direct-current voltage.

27. The electrophotographic apparatus according to claim 25, further comprising process speed control means by which said electrophotographic photosensitive member is drivable at two or more different process speeds.

* * * * *